US005954844A

United States Patent [19]

Law et al.

[11] Patent Number: 5,954,844

[45] Date of Patent: Sep. 21, 1999

[54] ABRASIVE ARTICLE COMPRISING AN ANTILOADING COMPONENT

[75] Inventors: Kam W. Law, Woodbury; Walter L. Harmer, Arden Hills; Alan R. Kirk, Cottage Grove; Ernest L. Thurber, Woodbury, all of Minn.

[73] Assignee: Minnesota Mining & Manufacturing Company, St. Paul, Minn.

[21] Appl. No.: 08/995,570

[22] Filed: Dec. 22, 1997

Related U.S. Application Data

[63] Continuation of application No. 08/689,960, Aug. 16, 1996, Pat. No. 5,704,952, which is a continuation-in-part of application No. 08/646,457, May 8, 1996, abandoned.

[51] Int. Cl.[6] ..... B24D 3/34

[52] U.S. Cl. ..... 51/306; 51/295

[58] Field of Search ..... 568/1, 6, 12, 14, 568/15, 17, 30, 31, 32, 33, 34, 35, 36, 37; 564/281, 282, 284, 291; 51/295, 306; 451/59, 28

[56] References Cited

U.S. PATENT DOCUMENTS

| | | | |
|---|---|---|---|
| 2,768,886 | 10/1956 | Twombly et al. | 51/295 |
| 2,893,854 | 7/1959 | Rinker et al. | 51/298 |
| 3,619,150 | 11/1971 | Rinker et al. | 51/295 |
| 4,396,403 | 8/1983 | Ibrahim | 51/295 |
| 4,609,380 | 9/1986 | Barnett et al. | 51/298 |
| 4,784,671 | 11/1988 | Elbel | 51/293 |
| 4,973,338 | 11/1990 | Geta et al. | 51/295 |
| 4,988,554 | 1/1991 | Peterson et al. | 428/142 |
| 5,164,265 | 11/1992 | Stubbs | 428/421 |
| 5,578,097 | 11/1996 | Gaeta et al. | 51/295 |

FOREIGN PATENT DOCUMENTS

| | | |
|---|---|---|
| 0 435 080 | 7/1991 | European Pat. Off. . |
| 42 37 298 | 4/1994 | Germany . |

OTHER PUBLICATIONS

Patent Abstracts of Japan, vol. 14, No.246, May 25, 1990, (JP 02067389 A), Mar. 1990.

Patent Abstracts of Japan, vol. 11, No.348, Nov. 14, 1987 (JP 62130181), Jun. 1987.

Patent Abstracts of Japan, vol. 15, No.333, Aug. 23, 1991 (JP 138246), May 1991.

*Primary Examiner*—Deborah Jones
*Attorney, Agent, or Firm*—Paul W. Busse

[57] ABSTRACT

An abrasive article, for example, a coated, bonded, or nonwoven abrasive article comprising a binder, a plurality of abrasive particles, and an antiloading component.

19 Claims, 3 Drawing Sheets

ABRASIVE ARTICLE COMPRISING AN ANTILOADING COMPONENT

CROSS-REFERENCE TO RELATED APPLICATIONS

This is a continuation of U.S. Ser. No. 08/689,960, filed Aug. 16, 1996, now U.S. Pat. No. 5,704,952, which is a continuation-in-part application of U.S. Ser. No. 08/646,457, filed May 8, 1996 now abandoned.

BACKGROUND OF THE INVENTION

1. Field of the Invention

The present invention relates to an abrasive article comprising a binder, abrasive grains, and an antiloading component.

2. Discussion of Related Art

There are numerous types of abrasive articles. For example, an abrasive article generally comprises abrasive particles bonded together as a bonded abrasive article, bonded to a backing as a coated abrasive article, or bonded into and/or onto a three-dimensional nonwoven substrate as a nonwoven abrasive article. Each type of abrasive article may also be in a variety of forms. For example, a coated abrasive article can comprise a first layer (also known as a make coat), a plurality of abrasive particles adhered thereto and therein, and a second layer (also known as a size coat). In some instances, a third layer (also known as a supersize coat) may be applied over the size coat. Alternatively, a coated abrasive article may be a lapping coated abrasive comprising an abrasive coating (which also can be referred to as an "abrasive layer") bonded to a backing where the abrasive coating comprises a plurality of abrasive particles dispersed in a binder. In addition, a coated abrasive article may be a structured abrasive comprising a plurality of precisely shaped abrasive composites bonded to a backing. In this instance, the abrasive composites comprise a plurality of abrasive particles.

Abrasives articles are used to abrade a wide variety of substrates or workpieces made from, for example, wood, plastic, fiberglass, or soft metal alloys, or having a layer of enamel or paint. Typically, there is some degree of space between these abrasive particles. During the abrading process, material abraded from the substrate or workpiece, also known as swarf, tends to fill the spaces between abrasive particles. The filling of spaces between abrasive particles with swarf and the subsequent build-up of swarf is known as loading. Loading presents a concern because the life of the abrasive article is reduced and the cut rate of the abrasive article decreases (thus, more force may be required to abrade). In addition, loading is an exponential problem; once swarf begins to fill in the spaces between abrasive particles, the initial swarf acts as a "seed" or "nucleus" for additional loading.

The abrasive industry has sought loading-resistant materials to use in as abrasive articles. Examples of loading-resistant materials which have been used include metal salts of fatty acids, urea-formaldehyde resins, waxes, mineral oils, crosslinked silanes, crosslinked silicones, and fluorochemicals. Preferred materials have been zinc stearate and calcium stearate. One theory for the success of metal stearates as an antiloading agent is that the metal stearate coating powders off the coated abrasive surface during the abrading process, which in turn causes the swarf to also powder off of the surface, thus reducing the amount of loading.

Stearate coatings for the prevention of loading have been utilized by the abrasives industry for several decades. It has been common to utilize a binder with the stearate to assist in applying and retaining the coating on the abrasive surface. Some minor improvements over the years have been made by utilizing stearates with higher melting points, for example, calcium or lithium stearate and by incorporating additives to enhance antiloading performance, for example, fluorochemicals.

Specific attempts to solve the problem of loading include those taught in U.S. Pat. Nos. 2,768,886 (Twombly); 2,893,854 (Rinker et al.); and 3,619,150 (Rinker et al.). U.S. Pat. No. 2,768,886 discloses an abrasive article with a coating of small, solid particles consisting essentially of stearates or palmitates. U.S. Pat. No. 2,893,854 discloses a coated abrasive article coated with a continuous film of a resin having uniformly dispersed small, solid particles of a water-insoluble metallic soap of a saturated fatty acid having from 16 to 18 carbon atoms. U.S. Pat. No. 3,619,150 discloses a coated abrasive article having a nonloading coating comprising a mixed resin composition of a thermosetting resin and either a thermoplastic or elastomeric resin and a water-dispersible metallic soap, in particular, a metallic water-insoluble soap of a C16 to C18 saturated fatty acid, dispersed throughout the resin composition.

U.S. Pat. No. 4,609,380 (Barnett) discloses an abrasive wheel having a binder system comprising a binder and a smear-reducing compatible polymer and conventional lubricants including metal stearate salts such as lithium stearate.

U.S. Pat. No. 4,784,671 (Elbel) discloses a process for improving the grinding performance of a porous ceramic or plastic bound grinding or honing body comprising filling the pore spaces at least in part with at least one metal soap, including salts and soaps of the fatty acids of lauric acid, myristic acid, palmitic acid, stearic acid, arachic acid, and behenic acid. A grinding performance improvement disclosed is reduction of clogged pores of the body to avoid rewelding and sheet metal jacket formations.

U.S. Pat. No. 4,988,554 (Peterson et al.) discloses a coated abrasive article having a backing having a layer of abrasive grains overcoated with a loading resistant coating comprising a lithium salt of a fatty acid on one side and a pressure-sensitive adhesive on the other side of the backing.

U.S. Pat. No. 4,396,403 (Ibrahim) discloses a coated abrasive article, which does not need a supersize coat of metal stearates or any other material, which instead incorporates phosphoric acids, partial esters of such acids, amine salts of such acids and partial esters, and/or quaternary ammonium salts with at least one long substituent group into amino resin or glue sizing adhesives during the manufacture of the coated abrasive article.

U.S. Pat. No. 4,973,338 (Gaeta et al.) discloses a coated abrasive that has been oversized with an antiloading amount of a quaternary ammonium anti-static compound comprising from about 15 to 35 carbon atoms and having a molecular weight not less than about 300. Examples of the quaternary ammonium compounds include (3-lauramido-propyl) trimethylammonium methyl sulfate, stearamidopropyldimethyl-beta-hydroxyethylammoniumnitrate, N,N-bis(2-hydroxyethyl)-N-(3'-dodecyloxy-2'-hydroxypropyl)methylammonium methosulfate and stearamidopropyl-dimethyl-beta-hydroxyethylammoniumdihydrogen phosphate. Typically, the quaternary ammonium compound is coated out of a solvent, typically an aqueous alcohol solvent system.

U.S. Pat. No. 5,164,265 (Stubbs) discloses an abrasive article having, either applied as a layer coated over existing layers of an abrasive article or incorporated into the coating formulation which will form the outermost layer of the binder, a fluorochemical compound selected from the group consisting of compounds comprising a fluorinated aliphatic group attached to a polar group or moiety and compounds having a molecular weight of at least about 750 and comprising a non-fluorinated polymeric backbone having a plurality of pendant fluorinated aliphatic groups comprising the higher of (a) a minimum of three C—F bonds, or (b) in which 25% of the C—H bonds have been replaced by C—F bonds such that the fluorochemical compounds comprises at least 15% by weight of fluorine.

Although the abrasive industry has widely used metal stearates with a good degree of success, the industry is always looking for improved antiloading components, particularly to lengthen product life. Although there have been a number of improvements recently for backings, bond systems, and minerals of coated abrasives, comparable improvements in antiloading components have not yet been achieved. That is, the industry is still seeking a component which is easy to apply, is relatively inexpensive, and can be utilized during abrading of a variety of workpieces including paint, wood, wood sealers, plastic, fiberglass, composite material, and automotive body fillers and putties.

SUMMARY OF THE INVENTION

In the present invention, an antiloading component for an abrasive article has been developed which meets the needs of the industry, i.e., the present invention relates to an abrasive article construction containing an antiloading component which significantly minimizes loading, is coatable, and is relatively inexpensive.

The present invention relates to an abrasive article comprising (a) a backing having a major surface; (b) a plurality of abrasive particles; (c) a binder which adheres the plurality of abrasive particles to the major surface of the backing; and (d) an antiloading component of any of formulas I to VI or mixtures thereof.

The invention also relates to a bonded abrasive comprising (a) a plurality of abrasive particles; (b) a binder adhering the plurality of abrasive particles together; and (c) an antiloading component of any of formulas I to VI or mixtures thereof.

In another embodiment, the invention relates to a nonwoven abrasive comprising (a) an open, lofty nonwoven substrate; (b) a plurality of abrasive particles; (c) a binder adhering the plurality of abrasive particles into and/or onto the open, lofty nonwoven substrate; and (d) an antiloading component of any of formulas I to VI or mixtures thereof.

The invention also relates to a method of making an abrasive article comprising (a) providing a backing having at least one major surface; (b) applying a make coat binder precursor over the at least one major surface of the backing; (c) embedding a plurality of abrasive particles into and/or onto the make coat binder precursor; (d) at least partially curing or solidifying the make coat binder precursor to form a make coat; (e) applying a size coat binder precursor over the plurality of abrasive particles and the make coat; (f) curing or solidifying the size coat binder precursor to form a size coat; (g) applying a peripheral composition over at least a portion of the size coat, said composition comprising an antiloading component of any of formulas I to VI or mixtures thereof; and (h) solidifying the composition to form a peripheral coating as well as a method of making an abrasive article comprising (a) providing a backing having at least one major surface; (b) applying a make coat binder precursor over the at least one major surface of the backing; (c) embedding a plurality of abrasive particles into and/or onto the make coat binder precursor; (d) at least partially curing or solidifying the make coat binder precursor to form a make coat; (e) applying a size coat binder precursor composition over the make coat and the plurality of abrasive particles, said size coat binder precursor composition comprising a size coat binder precursor and an antiloading component of any of formulas I to VI or mixtures thereof; and (f) curing or solidifying the size coat binder precursor to form a size coat.

The antiloading component of the present invention may be any of formulas I to VI or mixtures thereof:

I

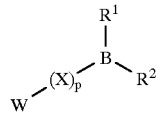

wherein $R^1$ and $R^2$ are independently OH, OR, $O^-$, $NH_2$, NHR, or $N(R)_2$, with the proviso that if either or both of $R^1$ and $R^2$ is $O^-$, then a cation is present;

R is an alkyl;

X is O, S, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group;

p is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon;

II

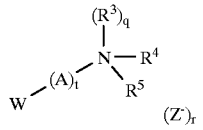

wherein $R^3$ is OH;

q is 0 or 1;

$Z^-$ is a monovalent anion;

r is 0 or 1, with the proviso that when q is 0, r is 0 and when q is 1, r is 1 and when q and r are 1, N carries a positive charge;

$R^4$ and $R^5$ independently are H or an alkyl group;

A is a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, with the proviso that the linking group is connected by a carbon atom to N of formula II;

t is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon;

III

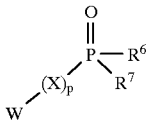

wherein $R^6$ and $R^7$ independently are $O^-$, OH, OR, $NH_2$, NHR, or $N(R)_2$, with the proviso that both $R^6$ and $R^7$ cannot be OH simultaneously or OR simultaneously, and one of $R^6$ and $R^7$ cannot be OH when the other of $R^6$ and $R^7$ is OR, and with the proviso that if either or both of $R^6$ and $R^7$ is $O^-$, a cation is present;

R is an alkyl group;

X is O, S, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group;

p is 0 or 1; and

W is an alkyl group, which nay be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon;

IV

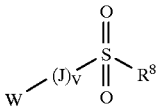

wherein $R^8$ is OH, OR, $O^-$, $NH_2$, NHR, $N(R)_2$, $N(R^9)(R^{10})(OR^{11})$, $N(CH_2CH_3)CH_2CH_2OC(O)CH{=}CH_2$, or

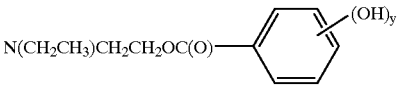

wherein when $R^8$ is $O^-$, then a cation is present;

R is an alkyl group;

$R^9$ is H, $CH_3$, or $CH_2CH_3$;

$R^{10}$ is $CH_2$ or $CH_2CH_2$;

$R^{11}$ is hydrogen or $C(O)CH{=}CH_2$;

J is O, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group;

v is 0 or 1;

y is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon;

$W\text{-}(A)_t\text{-}D$ V wherein D is a monovalent radical including any of: —OH, —N=C=O, $—CO_2H$, $—NR^{12}C(O)NR^{13}R^{14}$, $—C(O)NR^{15}R^{16}$, $OC(O)C(CH_2—CO_2H)_2(OH)$, $(—OOCCH_2)(HO_2C)C(OH)(CH_2CO_2H)$,

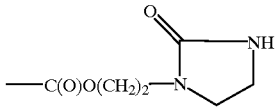

$—C(O)O(CH_2)_2—N$ $—NR^{12}C(O)(CH_2)_2CO_2H$, $—NR^{12}C(O)(CH_2)_3OH$, $—NHC(O)OR^{17}$, $—NR^{12}C(O)(CH_2)_2C(O)OR^{17}$, $—NR^{12}C(O)(CH{=}CH)C(O)OR^{17}$,

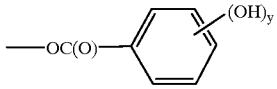

—OC(O)—, ,

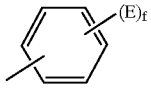

, $—QC(O)C(R^{18}){=}CH_2$,

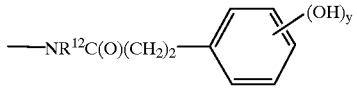

$—NR^{12}C(O)(CH_2)_2$—, , wherein if y is 1, OH is in an ortho position,

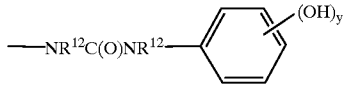

$—NR^{12}C(O)NR^{12}$—, ,

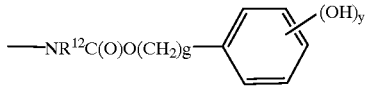

$—NR^{12}C(O)O(CH_2)g$—, ,

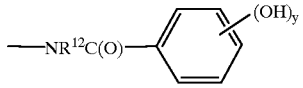

$—NR^{12}C(O)$—, , $—NR^{12}C(O)C(CH_3)_2NHC(O)CH{=}CH_2$,

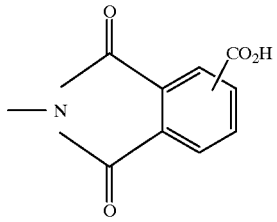

—N—, ,

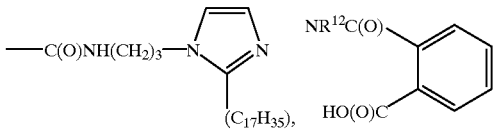

$—C(O)NH(CH_2)_3$—, $(C_{17}H_{35})$, $NR^{12}C(O)$, HO(O)C, ,

-continued

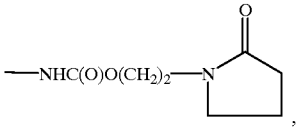

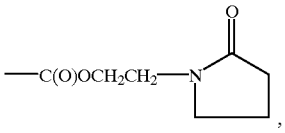

and

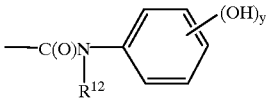

$R^{12}$ is hydrogen or an alkyl group having from one to four carbon atoms, $R^{13}$ and $R^{14}$ independently are hydrogen, an alkyl group, or an aliphatic group, which is substituted or unsubstituted, wherein the aliphatic group has 20 atoms or less and contains carbon and, optionally, nitrogen, oxygen, phosphorus, and/or sulfur in the aliphatic group or as a substituent to the aliphatic group;

$R^{15}$ and $R^{16}$ independently are hydrogen or an alkyl group;

$R^{17}$ is hydrogen or an alkyl group which may be saturated or unsaturated;

$R^{18}$ is hydrogen or $C_nH_{2n+1}$ where n is 1 to 8;

E is independently COOH or $COO^-$, wherein when one or two $COO^-$ groups are present, a cation is present;

Q is O or NH;

R is an alkyl group;

y is 1 to 3;

f is 1 or 2;

g is 1 to 6;

k is 0 or 1;

A is a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, with the proviso that when D is OH, N=C=O, or $NHC(O)NH_2$, the atom of A closest to D is a carbon atom;

t is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon; and

VI

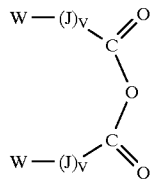

J is O, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, with the proviso that when J is a divalent aliphatic or aromatic linking group, the linking group is connected by a carbon atom to the C of formula VI;

v is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon.

DETAILED DESCRIPTION OF THE INVENTION

Figure 1:
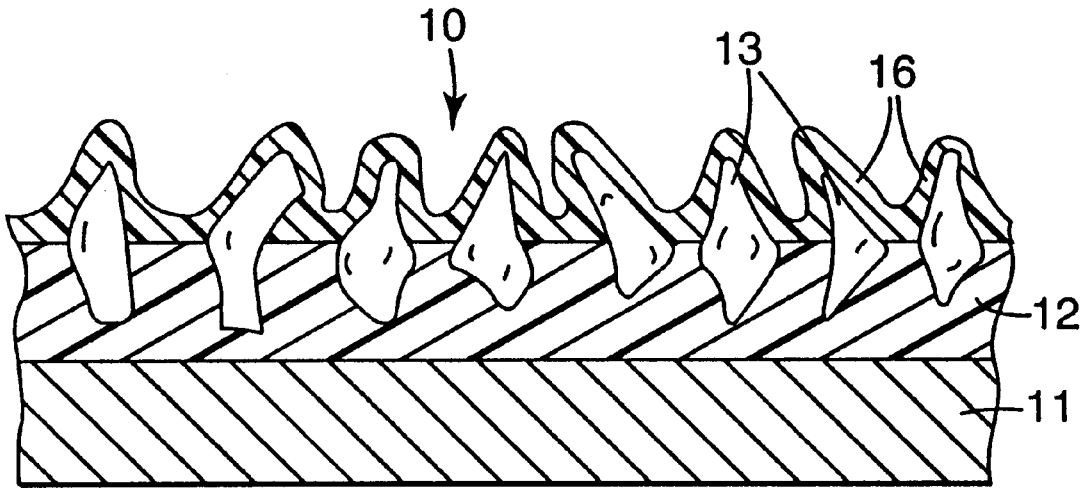
FIG. 1 is a cross-section of a coated abrasive article in accordance with the present invention.

Abrasive articles and methods of making and using abrasive articles in accordance with the present invention will be discussed in more detail below.

Abrasive Articles

Abrasive articles typically comprise a plurality of abrasive particles adhered by a bond system comprising a binder which can be derived from a binder precursor. Examples of abrasive articles include coated abrasive articles such as lapping or structured abrasive articles, bonded abrasive articles, and nonwoven abrasive articles.

Abrasive articles generally comprise abrasive particles secured within a binder. In a bonded abrasive, the binder bonds the abrasive particles together in a shaped mass. Typically, this shaped mass is in the form of a wheel and thus it is commonly referred to as a grinding wheel. In nonwoven abrasives, the binder bonds the abrasive particles into and/or onto a lofty, open, fibrous substrate. In coated abrasives, the binder bonds the abrasive particles to a substrate or backing.

Abrasive articles of the present invention comprise an antiloading component in a part of the abrasive article which will ultimately contact a workpiece during abrading, preferably in peripheral portion of the abrasive article capable of contacting a workpiece. The term "peripheral portion" as used herein refers to the outermost portion of an abrasive article which contacts a workpiece to be abraded. Thus, "a peripheral portion" may refer to a peripheral coating or a binder if a peripheral coating is not present. The term "peripheral coating" as used herein refers to a coating present on top of a binder of an abrasive article, for example, a binder of a size coat, abrasive composite, or abrasive coating, or a binder of a nonwoven or bonded abrasive article.

Coated Abrasive Articles

Coated abrasive articles of the invention may be produced with coatable binder precursor compositions, described herein, on a backing. As mentioned above, there are a variety of types of coated abrasive articles.

A backing for a coated abrasive article of the present invention can be any number of various materials conventionally used as backings in the manufacture of coated abrasives, such as paper, cloth, film, polymeric foam, vulcanized fibre, woven and nonwoven materials, and the like, or a combination of two or more of these materials or treated versions thereof. The choice of backing material will depend on the intended application of the abrasive article. The strength of the backing should be sufficient to resist tearing or other damage in use, and the thickness and smoothness of the backing should allow achievement of the product thickness and smoothness desired for the intended application.

The backing may also be a fibrous reinforced thermoplastic, for example, as disclosed in U.S. Pat. No. 5,417,726 (Stout), or an endless spliceless belt, for example, as disclosed in WO 93/12911 (Benedict et al.). Likewise, the backing may be a polymeric substrate having hooking stems projecting therefrom, for example, as disclosed in WO 95/19242 (Chesley et al.). Similarly, the backing may be a loop fabric, for example, as described in WO 95/11111 (Follett et al.).

The backing may be smooth, textured, or perforated and may have a thickness ranging generally from about 25 to about 10,000 micrometers, typically from 25 to 1000 micrometers.

The backing may comprise a polymeric film, cloth, paper sheet, treated versions thereof, a screen made from plastic or metal, and treated or untreated combinations thereof. In some applications it is also preferable that the backing be waterproof. The thickness of the backing should be sufficient to provide the strength desired for the intended application; nevertheless, it should not be so thick as to affect the desired flexibility in the coated abrasive product. The film backing may be made from a thermoplastic material such as polyamides (nylon), polyester, polypropylene, polyethylene, polyurethane, combinations thereof, and the like. The film backing may also be a microvoided film backing. As used herein "microvoided" means that the film has internal porosity. A particularly preferred film is a microvoided polyester (preferably polyethylene terephthalate) film having a thickness ranging from 0.01 mm to 0.25 mm, more preferably 0.05 mm. An example of a microvoided polyester film is one which is commercially available from ICI Limited, United Kingdom under the trade designation "475/200 MELINEX MV". The film backings may be primed or unprimed. The backing may also be a laminate of paper/film, two polymeric films, paper/cloth film, film/nonwoven material, and the like.

Figure 2:
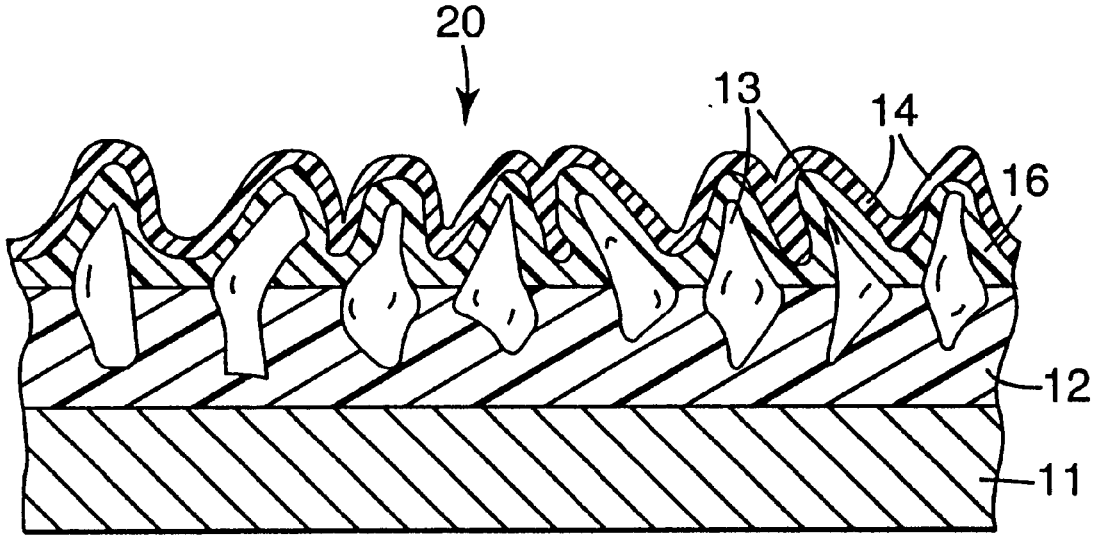
FIG. 2 is a cross-section of another embodiment of a coated abrasive article in accordance with the present invention.

With reference to FIG. 1, a coated abrasive article 10 of the present invention may include a first coating layer 12 (commonly referred to as a make oat) bonded to one side (a major surface) of the backing 11, at least one layer of abrasive particles 13 bonded to the backing by the make coat 12, and a second coating layer 16 (commonly referred to as a size coat), comprising an antiloading component of the present invention, overlaying the abrasive particles. With reference to FIG. 2, a coated abrasive article 20 of the present invention may include a first coating layer 12, a backing 11, at least one layer of abrasive particles 13, and a second coating layer 16 as described with respect to FIG. 1 as well as a peripheral coating 14, comprising an antiloading component of the present invention, over at least a portion of the second coating layer 16.

Coated abrasives of the present invention also include lapping abrasive articles and structured coated abrasive articles. A lapping coated abrasive article comprises a backing having an abrasive coating bonded to the backing. The abrasive coating comprises a plurality of abrasive particles distributed in a binder. In some instances, the binder bonds this abrasive coating to the backing. Alternatively, an additional material may be used to bond the abrasive coating to the backing, which may be selected, for example, from the binder precursors described herein and may be the same or different than the binder precursor used to form the abrasive coating. Generally, the particle size of the abrasive particles used in a lapping coated abrasive ranges, on average, from about 0.1 to less than about 200 micrometers, typically, 0.1 to 120 micrometers. The abrasive coating may have a smooth outer surface or a textured outer surface. The abrasive coating may also further comprise additives as discussed herein.

Figure 3:
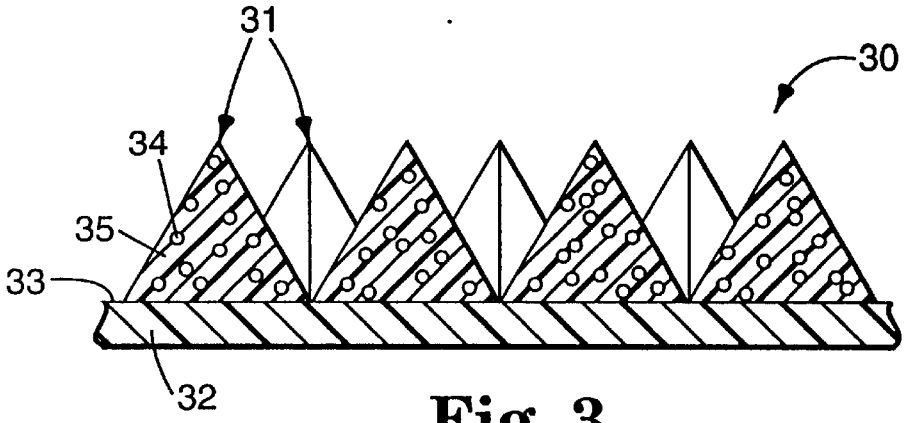
FIG. 3 is a cross-section of a structured abrasive article in accordance with the present invention.
Figure 4:
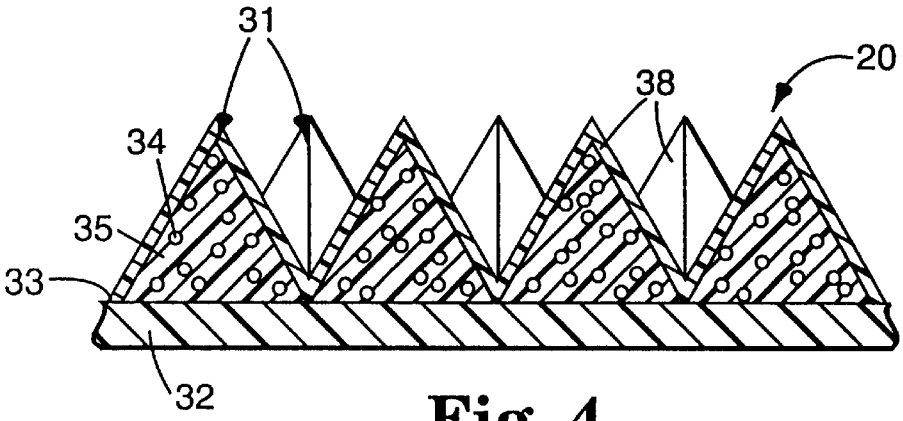
FIG. 4 is a cross-section of another embodiment of a structured abrasive article in accordance with the present invention.

With reference to FIG. 3, a structured abrasive article 30 comprises a backing 32 having a plurality of precisely shaped abrasive composites 31 bonded to a major surface 33 of the backing 32. These abrasive composites comprise a plurality of abrasive particles 34 distributed in a binder 35, comprising an antiloading component of the present invention. In some instances, the binder 35 bonds the abrasive composites to the backing. Alternatively, an additional material may be used to bond the abrasive composite to the backing, which may be selected, for example, from the binder precursors described herein and may be the same or different than the binder precursor used to form the abrasive composite. With reference to FIG. 4, a structured abrasive may comprise, in addition to a backing 32 having a major surface 33, and a plurality of abrasive composites 31 comprising a binder 35 and a plurality of abrasive particles 34, a peripheral coating 38, comprising an antiloading component of the present invention, over at least a portion of the plurality of abrasive composites 31.

Generally, the particle size range for abrasive particles used in a structured coated abrasive is the same as that used for a coated abrasive article comprising a make coat and size coat as described herein. The abrasive composites may also comprise additives that are discussed herein.

Each of the embodiments of a coated abrasive article may contain a peripheral coating which overlays the binder and abrasive particles of the abrasive article. For example, the peripheral coating may overlay a size coat, an abrasive coating, or abrasive composites. This coating is commonly referred to as a supersize coat for coated abrasive articles having make and size coats.

In a coated abrasive article of the present invention, an antiloading component is present in a part of the abrasive article which will ultimately contact a workpiece during abrading, preferably in a peripheral portion of the coated abrasive article capable of contacting a workpiece. For example, the antiloading component of the present invention may be in a binder of a size coat, an abrasive coating, or an abrasive composite, whether or not a peripheral coating is present; or in a peripheral coating over at least a portion of the size coat, abrasive coating, or abrasive composites. The antiloading component of the present invention may be present in a binder and in a peripheral coating, if present.

In some instances, it may be preferred to incorporate a pressure sensitive adhesive onto the back side of the coated abrasive such that the resulting coated abrasive can be secured to a back up pad. Representative examples of pressure sensitive adhesives suitable for this invention include latex crepe, rosin, acrylic polymers and copolymers e.g., polybutylacrylate, polyacrylate ester, vinyl ethers, e.g., polyvinyl n-butyl ether, alkyd adhesives, rubber adhesives, e.g., natural rubber, synthetic rubber, chlorinated rubber, and mixtures thereof. A preferred pressure sensitive adhesive is an isooctylacrylate:acrylic acid copolymer.

Figure 9:
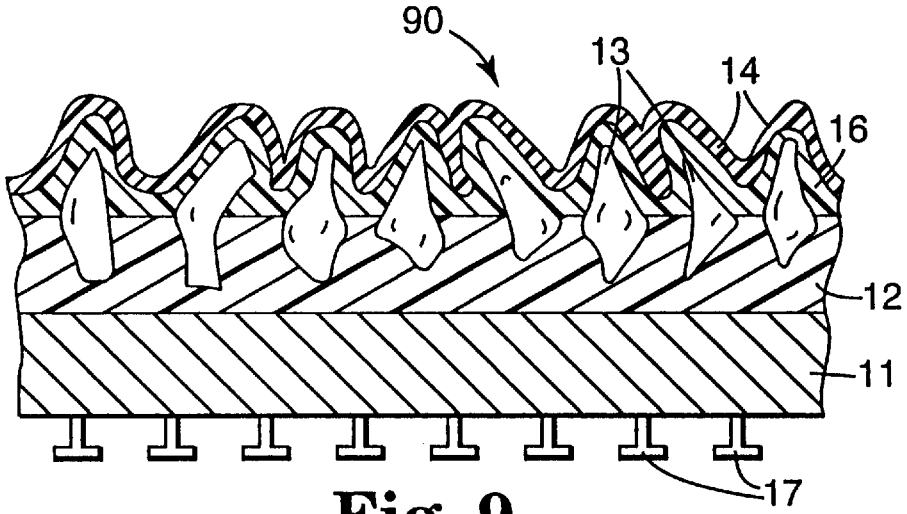
FIG. 9 is a cross-section of another embodiment of a coated abrasive article in accordance with the present invention.

Alternatively, the coated abrasive may contain a hook and loop type attachment system to secure the coated abrasive to the back up pad. The loop fabric may be on the back side of the coated abrasive with hooks on the back up pad. Alternatively, the hooks may be on the back side of the coated abrasive with the loops on the back up pad. With reference to FIG. 9, the coated abrasive 90 may include a first coating layer 12 bonded to a major surface of the backing 11, at least one layer of abrasive particles 13 bonded to the backing 11 by the first coating layer 12, and a second coating layer 16 overlaying the abrasive particles, a third coating layer 14 (also referred to as a peripheral coating), comprising an antiloading component of the present invention, over at least a portion of the second coating layer 16, and hooks 17 attached to the backing 11 on the back side, i.e., the side opposite to the major surface of the backing 11 bearing abrasive particles 13.

This hook and loop type attachment system is further described in U.S. Pat. Nos. 4,609,581 and 5,254,194, WO 95/19242 and U.S. Ser. Nos. 08/181,192; 08/181,193; and 08/181,195, all incorporated herein by reference. For example, a make coat precursor may be coated directly onto a loop fabric, which may be a chenille stitched loop, a stitchbonded loop (for example, as disclosed in U.S. Pat. No. 4,609,581 (Ott), incorporated herein by reference), or a brushed loop, for example, brushed nylon. The loop fabric may also contain a sealing coat to seal the loop fabric and prevent the make coat precursor from penetrating into the loop fabric. Alternatively, the make coat precursor may be coated directly onto the loop fabric, for example, as disclosed in WO 95/11111 (Follett et al.), incorporated herein by reference. In this arrangement, the loop fabric can releasably engage with hooking stems present on a support pad. The make coat precursor may also be coated directly on a hooking stem substrate, which generally comprises a substrate having a front and back surface. The make coat precursor can then be applied to the front surface of the substrate, the hooking stems protruding from the back surface. In this arrangement, the hooking stems can releasably engage with a loop fabric present on a support pad.

It is also within the scope of this invention to have a binder and plurality of abrasive particles adhered directly to a loop fabric and have the antiloading component present in the binder or in a peripheral coating.

The coated abrasive can be in the form of a roll of abrasive discs, as described in U.S. Pat. No. 3,849,949 (Steinhauser et al.) incorporated herein by reference.

The coated abrasive may be converted into a variety of different shapes and forms such as belts, discs, sheets, tapes, daisies and the like. The belts may contain a splice or a joint, alternatively the belts may be spliceless such as that taught by in WO 93/12911 incorporated herein by reference. The belt width may range from about 0.5 cm to 250 cm, typically anywhere from about 1 cm to 150 cm. The belt length may range from about 5 cm to 1000 cm, typically 10 cm to 500 cm. The belt may have straight or scalloped edges. The discs may contain a center hole or have no center hole. The discs may have the following shapes: round, oval, octagon, pentagon, hexagon or the like; all of these converted forms are well known in the art. The discs may also contain dust holes, typically for use with a tool containing a vacuum source. The diameter of the disc may range from about 0.1 cm to 1500 cm, typically from 1 cm to 100 cm. The sheets may be square, triangular, or rectangular. The width ranges from about 0.01 cm to 100 cm, typically 0.1 cm to 50 cm. The length ranges from about 1 cm to 1000 cm, typically 10 cm to 100 cm.

Figure 7:
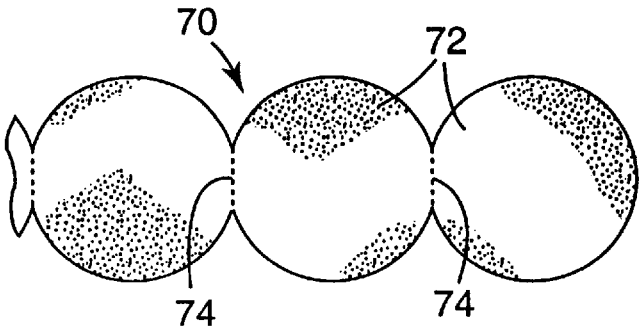
FIG. 7 is a reduced plan view of a portion of a concatenate of abrasive discs in accordance with the present invention.

For example, FIG. 7 shows a plan view (reduced) of an abrasive article of the invention, a concatenation 70 of edge-connected coated abrasive discs 72 capable of being convolutely wound to form a roll which can be easily unrolled. Alternately, other shapes of coated abrasive can be used. A concatenation of coated abrasive is more fully described in assignee's U.S. Pat. No. 3,849,949, incorporated herein by reference. Each disc 72 preferably has a structure as shown in cross-section in FIGS. 1 and 2 and is joined to at least one other similarly constructed disc 72 along a straight edge 74 of the disc formed by removal of a small segment defined by a chord having a length less than ½ the radius of the disc. Straight edge 74 is preferably perforated for easy separation of the discs along the chord; however, perforation is not necessary. This concatenation 70 of coated abrasive discs, when wound into a roll, has a binder (for example as shown in FIG. 1) or peripheral coating (for example, as shown in FIG. 2), comprising an antiloading component of the present invention, of one disc 72 in direct, releasable contact with the PSA on the back side of another disc 72 when the concatenation is convolutely wound. The discs can be easily separated from one another when desired.

Figure 8:
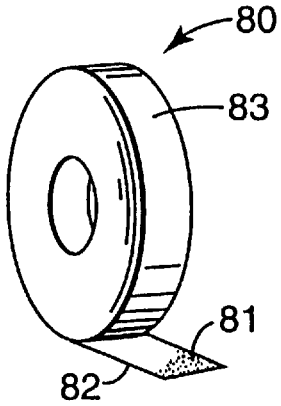
FIG. 8 is a greatly reduced perspective view of a roll of coated abrasive material in accordance with the present invention.

Alternatively, with reference to FIG. 8, which shows a reduced perspective view of another preferred article of the invention, a packaged roll 80 of coated abrasive employing an antiloading component of the present invention may be used. Roll 80 comprises an elongated sheet of coated abrasive material 82 of the type shown in cross-section in either FIGS. 1 or 2. The materials of construction suitable for roll 80 can be the same as those used in aforementioned coated abrasive articles 10 and 20. In FIG. 8, it can be seen that when the coated abrasive material is wound into a roll, a binder or peripheral coating 81, comprising an antiloading component of the present invention, will be in direct, releasable contact with a layer of PSA 83. When the user desires to remove a piece of coated abrasive material from roll 80, the user merely unwinds a portion of roll 80 and cuts or tears this portion from the roll.

When a PSA is used, if necessary to prevent transfer of the antiloading component to the PSA or vice versa, a release liner may be used, the roll may be wound loosely, or a binder may be incorporated along with the antiloading component.

It is also feasible to adhere the abrasive particles to both a major or working surface and the opposite surface of a backing. The abrasive particles can be the same or different from one another. In this aspect, the abrasive article is essentially two sided; one side can contain a plurality of abrasive particles which are different from a plurality of abrasive particles on the other side. Alternatively, one side can contain a plurality of abrasive particles having a different particle size than those on the other side. In some instances, this two sided abrasive article can be used in a manner in which both sides of the abrasive article abrade at the same time. For example, in a small area such as a corner, one side of the abrasive article can abrade the top workpiece surface, while the other side can abrade the bottom workpiece surface.

Nonwoven Abrasive Articles

Figure 5:
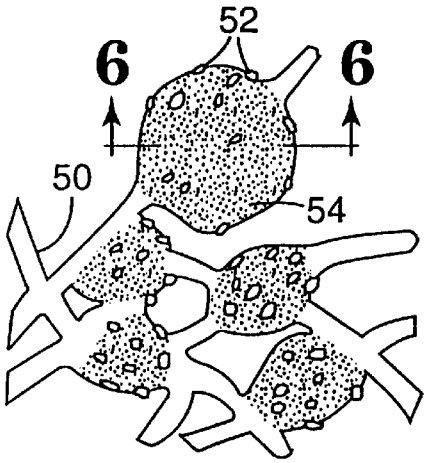
FIG. 5 is a partial expanded view of a nonwoven abrasive article in accordance with the present invention.
Figure 6A:
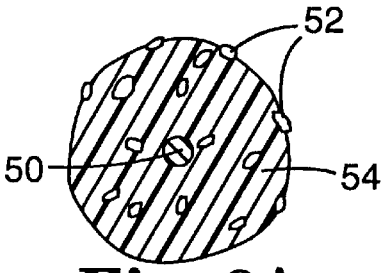
FIG. 6A is a cross-section taken along line 6—6 of FIG. 5.
Figure 6B:
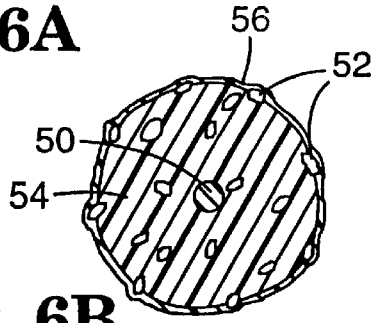
FIG. 6B is a view like FIG. 6A of an alternate embodiment of the present invention.

Nonwoven abrasive articles are also within the scope of the invention and include an open, lofty fibrous substrate having a binder which binds fibers at points where they contact. Optionally, abrasive particles or nonabrasive particles (such as fillers) may be adhered to the fibers by the binder if the manufacturer desires. For example, with reference to FIG. 5, a nonwoven abrasive comprises an open, lofty, fibrous substrate comprising fibers 50 and binder 54 which binds a plurality of abrasive particles 52 and an antiloading component of the present invention (not shown) to the fibers. FIG. 6A illustrates a view, along line 6—6, of binder 54 and abrasive particles 52. In the embodiment represented by FIG. 6A, binder 54 is combined with an antiloading component (not shown) of the present invention. FIG. 6B illustrates another embodiment of the present invention wherein a peripheral coating 56, comprising antiloading component of the present invention, is coated over at least a portion of the binder 54 and abrasive particles 52.

Nonwoven abrasives are described generally in U.S. Pat. Nos. 2,958,593 (Hoover et al.) and 4,991,362, which are incorporated herein by reference. In the present invention, an antiloading component is present in a part of the abrasive article which will ultimately contact a workpiece during abrading, for example, in a peripheral portion of the nonwoven abrasive article, for example, in a binder or in a peripheral coating over at least a portion of the binder.

Bonded Abrasive Articles

Bonded abrasive articles are also within the scope of the invention. A bonded abrasive article comprises a binder which adheres abrasive particles together in the form of a molded product. Bonded abrasives are described generally in U.S. Pat. No. 4,800,685 (Haynes), incorporated herein by reference.

In the present invention, an antiloading component is present in a part of the abrasive article which will ultimately contact a workpiece during abrading, for example, in a peripheral portion of the bonded abrasive article, for example, in a binder or in a peripheral coating over at least a portion of the binder.

Methods of Making Abrasive Articles

Coated Abrasive Articles

Coated abrasive articles of the present invention may be prepared using coatable binder precursors. These binder precursors may be used independently, to form a treatment coating for the backing, for example, a back coating (backsize coat), front coating (presize coat), or saturant coating; a make coat to which abrasive particles are initially anchored; a size coat for tenaciously holding abrasive particles to the backing, or any combination of the aforementioned coatings. In addition, a binder precursor can be used in coated abrasive article embodiments where only a single coating binder is employed, i.e., where a single coating takes the place of a make coat/size coat combination, for example, in a lapping coated abrasive.

When a coatable binder precursor described herein is applied to a backing in one or more treatment steps to form a treatment coating, the treatment coating can be cured thermally by passing the treated backing over a heated drum; there is no need to festoon cure the backing in order to set the treatment coating or coatings.

Reference to preparing a coated abrasive article having a make and size coat is set forth. After the backing has been properly treated with a treatment coating, if desired, a make coat binder precursor can be applied. After the make coat binder precursor is applied, abrasive particles can be applied into and over the make coat binder precursor. The abrasive particles can be drop coated or electrostatically coated. Next, the make coat binder precursor, now bearing abrasive particles, can be exposed to a heat source which generally solidifies or sets the binder sufficiently to hold the abrasive particles to the backing. In some instances, the make coat binder precursor can be partially cured before the abrasive particles are embedded into the make coat as described in U.S. Pat. No. 5,368,618 (Masmar et al.). Then, a size coat binder precursor can be applied. The make coat binder precursor and/or size coat binder precursor can be applied by any suitable method including roll coating, spraying, die coating, curtain coating, and the like. The temperature of the make coat binder precursor and/or size coat binder precursor can be room temperature or higher, preferably from 30 to 60° C., more preferably from 30 and 50° C. The size coat binder precursor/abrasive particle/(at least partially cured) make coat combination can be exposed to a heat source, for example, via a festoon or drum cure, or, alternatively, a radiation source. The size coat binder precursor may contain, for example, acrylates and a photoinitiator. In this instance, the binder precursor may be exposed to ultraviolet irradiation immediately after the size coat binder precursor is applied and prior to exposure to the heat source described above. Exposure to a heat source will substantially cure or set the make and size coat binder precursor used in the coated abrasive constructions. Standard thermal cure conditions can be used to effect curing, for example, temperatures between 50 to 150° C., typically 75 to 120° C., preferably 80 to 115° C. An optional supersize coat binder precursor may be applied over the size coat by any conventional technique and cured by the standard thermal cure conditions described herein.

It is also feasible to use a hot melt binder precursor, for example as disclosed in WO 95/11111, incorporated herein by reference, to form a coated abrasive article. The hot melt make coat binder precursor can be prepared by mixing the components of the hot melt resin in a suitable vessel, preferably one that is not transparent to actinic radiation, at an elevated temperature sufficient to liquify the materials so that they may be efficiently mixed but without thermally degrading them (e.g., a temperature of about 120° C.) with stirring until the component(s) are thoroughly melt blended. The components may be added simultaneously or sequentially. One preferred hot melt binder precursor comprises an epoxy-containing material, a polyester component having hydroxyl-containing end groups, and an initiator, preferably a photoinitiator, for example, as disclosed in U.S. Pat. No. 5,436,063 (Follett et al.), incorporated herein by reference.

It is also possible to provide the hot melt make coats as uncured, unsupported rolls of tacky, pressure sensitive adhesive film. Such films are useful in laminating the make coat to an abrasive article backing. It is desirable to roll the tacky film up with a release liner (for example, silicone-coated Kraft paper), with subsequent packaging in a bag or other container that is not transparent to actinic radiation.

The hot melt make coats may be applied to the abrasive article backing by extruding, gravure printing, or coating, (e.g., by using a coating die, a heated knife blade coater, a roll coater, a curtain coater, or a reverse roll coater). When applying by any of these methods, it is preferred that the make coat be applied at a temperature of about 100° to 125° C., more preferably from about 80° to 125° C. Coating is a desirable application method for use with J weight cloth backings and other fabric backings of similar porosity.

The hot melt make coats can be supplied as free standing, unsupported pressure sensitive adhesive films that can be laminated to the backing and, if necessary, die cut to a predefined shape before lamination. Lamination temperatures and pressures are selected so as to minimize degradation of the backing and bleed through of the make coat and may range from room temperature to about 120° C. and about 30 to 250 psi. A typical profile is to laminate at room temperature and 100 psi. Lamination is a particularly preferred application method for use with highly porous backings, for example, as described in WO 95/11111, incorporated herein by reference.

Preferably, the hot melt make coat is applied to the abrasive article backing by any of the methods described herein, and once so applied is exposed to an energy source to initiate the curing of the epoxy-containing material. The epoxy-containing material is believed to cure or crosslink with itself.

In an alternative manufacturing approach, the make coat is applied to the backing and the abrasive particles are then projected into the make coat followed by exposure of the make coat to an energy source.

A size coat may be subsequently applied over the abrasive particles and the make coat as a flowable liquid by a variety of techniques such as roll coating, spray coating or curtain coating and can be subsequently cured by drying, heating, or with electron beam or ultraviolet light radiation. The particular curing approach may vary depending on the chemistry of the size coat.

A structured coated abrasive may be prepared as described in assignees' U.S. Pat. Nos. 5,152,917 (Pieper et al) and 5,435,816 (Spurgeon et al.), both of which are incorporated herein by reference. One method involves 1) introducing the abrasive slurry onto a production tool, wherein the production tool has a specified pattern; 2) introducing a backing to the outer surface of the production tool such that the slurry wets one major surface of the backing to form an intermediate article; 3) at least partially curing or gelling the resinous adhesive (i.e., binder precursor) before the intermediate article departs from the outer surface of the production tool to form a structured coated abrasive article; and 4) removing the coated abrasive article from the production tool. In another method involves 1) introducing the abrasive slurry onto the backing such that the slurry wets the front side of the backing forming an intermediate article; 2) introducing the intermediate article to a production tool having a specified pattern; 3) at least partially curing or gelling the resinous adhesive (i.e., binder precursor) before the intermediate article departs from the outer surface of the production tool to form a structured coated abrasive article; and 4) removing the structured coated abrasive article from the production tool. If the production tool is made from a transparent material, e.g., a polypropylene or polyethylene thermoplastic, then either visible or ultraviolet light can be transmitted through the production tool and into the abrasive slurry to cure the resinous adhesive (i.e., binder precursor). Alternatively, if the coated abrasive backing is transparent to visible or ultraviolet light, visible or ultraviolet light can be transmitted through the coated abrasive backing. In these two methods, the resulting solidified abrasive slurry or abrasive composite will have the inverse pattern of the production tool. By at least partially curing or solidifying on the production tool, the abrasive composite has a precise and predetermined pattern. The resinous adhesive (i.e., binder precursor) can be further solidified or cured off the production tool.

A lapping coated abrasive can be prepared by coating an abrasive slurry onto at least one side of a backing. A preferred backing is a polymeric film, such as polyester film that contains a primer. Coating can be accomplished by spraying, rotogravure coating, roll coating, dip coating or knife coating. After the coating process, the slurry can be solidified, to form an abrasive coating, by exposure to an energy source including thermal and radiation energy (e.g., electron beam, ultraviolet light and visible light).

In any coated abrasive article of the present invention, an antiloading component can be incorporated in a binder precursor which forms a peripheral portion of the abrasive article. For example, the antiloading component may be incorporated in a make coat precursor, a size coat binder precursor, or an abrasive slurry. The antiloading component can be combined with the binder precursor using any suitable method, including but not limited to a mill having a half horsepower motor, for example, commercially available from Charles Ross and Son Company, Hauppauge, N.Y., under the trade designation "Ross Mill Model ME 100L". The antiloading component may be present in a peripheral composition, if present, for example, a supersize coat of a coated abrasive article also having a make, a plurality of abrasive particles, and a size coat construction. The antiloading component is, in all embodiments, present in a part of the coated abrasive article which will ultimately contact a workpiece during abrading.

Nonwoven Abrasive Articles

A nonwoven abrasive article may be prepared by combining a binder precursor with abrasive particles and optional additives to form a coatable, binder precursor slurry. The slurry can be coated, for example, by roll coating or spray coating, onto at least a portion of the fibers of a lofty, open fibrous web, and the resulting structure subjected to conditions sufficient to affect curing of the binder precursor, as described herein.

A general procedure for making lofty, open nonwoven abrasives includes those generally illustrated in U.S. Pat. No. 2,958,593, and those prepared according to the teachings of U.S. Pat. Nos. 4,991,362 and 5,025,596, all of which are hereby incorporated by reference.

An antiloading component of the present invention can be included in the slurry prior to coating or in a peripheral composition applied to at least a portion of the cured slurry to form a peripheral coating. The antiloading component is, in all embodiments, present in a part of the nonwoven abrasive article which will ultimately contact a workpiece during abrading.

Bonded Abrasive Articles

A general procedure for making a bonded abrasive of the invention includes mixing together binder precursor, abrasive particles, and optional additives to form a homogenous mixture. This mixture is then molded to the desired shape and dimensions. The binder precursor is then subjected to conditions, described herein, sufficient to affect curing and/or solidification to form a bonded abrasive.

An antiloading component of the present invention can be included in the binder precursor prior to curing or in a peripheral composition applied to at least a portion of the molded product to form a peripheral coating. The antiloading component is, in all embodiments, present in a part of the bonded abrasive article which will ultimately contact a workpiece during abrading.

Binder System

A binder in accordance with the present invention comprises a cured or solidified binder precursor and serves to adhere a plurality of abrasive particles together (as in a bonded abrasive article) or to a substrate (i.e., a backing for a coated abrasive or a nonwoven for a nonwoven abrasive).

The term "binder precursor" as used herein refers to an uncured or a flowable binder.

Organic binders suitable for an abrasive article of the present invention are formed from an organic binder precursor; it is, however, within the scope of the present invention to use a water-soluble binder precursor or water-dispersible binder precursor, such as hide glue. The binder precursor is preferably a thermosetting resin. Examples of thermosetting resins include phenolic resins, aminoplast resins having pendant α,β-unsaturated carbonyl groups, urethane resins, epoxy resins, urea-formaldehyde resins, isocyanurate resins, melamine-formaldehyde resins, acrylate resins, acrylated isocyanurate resins, acrylated urethane resins, acrylated epoxy resins, bismaleimide resins, and mixtures thereof.

Phenolic resins are commonly used as an abrasive article binder precursor because of their thermal properties, availability, cost and ease of handling. There are two types of phenolic resins, resole and novolac. Resole phenolic resins have a molar ratio of formaldehyde to phenol, of greater than or equal to one to one, typically between 1.5:1.0 to 3.0:1.0. Novolac resins have a molar ratio of formaldehyde to phenol, of less than one to one. The phenolic resin is preferably a resole phenolic resin. Examples of commercially available phenolic resins include those known under the trade designations "Varcum" and "Durez" from Occidental Chemical Corp., Tonawanda, N.Y.; "Arofene" and "Arotap" from Ashland Chemical Company, Columbus, Ohio; "Resinox" from Monsanto, St. Louis, Mo.; and "Bakelite" from Union Carbide, Danbury, Conn.

It is also within the scope of the present invention to modify the physical properties of a phenolic resin. For example, a plasticizer, latex resin, or reactive diluent may be added to a phenolic resin to modify flexibility and/or hardness of the cured phenolic binder.

A preferred aminoplast resin is one having at least one pendant α,β-unsaturated carbonyl groups per molecule, which can be prepared according to the disclosure of U.S. Pat. No. 4,903,440 (Larson et al.) which is incorporated herein by reference.

Aminoplast resins have at least one pendant α,β-unsaturated carbonyl group per molecule or oligomer. These unsaturated carbonyl groups can be acrylate, methacrylate or acrylamide type groups. Examples of such materials include N-hydroxymethyl-acrylamide, N,N'-oxydimethylenebisacrylamide, ortho and para acrylamidomethylated phenol, acrylamidomethylated phenolic novolac and combinations thereof. These materials are further described in U.S. Pat. Nos. 4,903,440; 5,055,113; and 5,236,472 all incorporated herein by reference.

Polyurethanes may be prepared by reacting near stoichiometric amounts of polyisocyanates with polyfunctional polyols. The more common types of polyisocyanates are toluene diisocyanate (TDI) and 4,4'-diisocyanatodiphenylmethane (MDI) which are available under the trade designations "Isonate" from Upjohn Polymer Chemicals, Kalamazoo, Mich. and "Mondur" from Miles, Inc., Pittsburgh, Pa. Common polyols for flexible polyurethanes are polyethers such as polyethylene glycols, which are available under the trade designations "Carbowax" from Union Carbide, Danbury, Conn.; "Voranol" from Dow Chemical Co., Midland, Mich.; and "Pluracol E" from BASF Corp., Mount Olive, N.J.; polypropylene glycols, which are available under the trade designations "Pluracol P" from BASF Corp. and "Voranol" from Dow Chemical Co., Midland, Mich.; and polytetramethylene oxides, which are available under the trade designations "Polymeg" from QO Chemical Inc., Lafayetts, Ind.; "Poly THF" from BASF Corp., Mount Olive, N.J.; and "Tetrathane" from DuPont, Wilmington, Del. Hydroxyl functional polyesters are available under the trade designations "Multranol" and "Desmophene" from Miles, Inc., Pittsburgh, Pa. Virtually all polyurethane formulations incorporate one or more catalysts. Tertiary amines and certain organometallic compounds, especially those based on tin, are most common. Combinations of catalysts may be used to balance the polymer-formation rate.

Epoxy resins have an oxirane ring and are polymerized by the ring opening. Such epoxide resins include monomeric epoxy resins and polymeric epoxy resins. These resins can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxyphenol)propane (diglycidyl ether of bisphenol A)] and commercially available materials under the trade designations, "Epon 828", "Epon 1004", and "Epon 1001F", available from Shell Chemical Co., Houston, Tex.; "DER-331", "DER-332", and "DER-334" available from Dow Chemical Co., Midland, Mich. Other suitable epoxy resins include glycidyl ethers of phenol formaldehyde novolac (e.g., "DEN-431" and "DEN-438" available from Dow Chemical Co., Midland, Mich.). Other epoxy resins include those described in U.S. Pat. No. 4,751,138 (Tumey et al.), incorporated herein by reference.

Urea-aldehyde resins employed in binder precursor compositions of the present invention may be comprised of urea or any urea derivative and any aldehyde which are capable of being rendered coatable, have the capability of reacting together at an accelerated rate in the presence of a catalyst, preferably a cocatalyst, and which afford an abrasive article with abrading performance acceptable for the intended use. The resins comprise the reaction product of an aldehyde and a "urea" (as further defined herein). Urea-formaldehyde resins are generally preferred in the abrasive industry, as noted above, because of their thermal properties, availability, low cost, and ease of handling. Urea-aldehyde resins preferably are 30–95% solids, more preferably 60–80% solids, with a viscosity ranging from about 125 to about 1500 cps (Brookfield viscometer, number 3 spindle, 30 rpm 25° C.) before addition of water and catalyst and have molecular weight (number average) of at least about 200, preferably varying from about 200 to 700. Urea aldehyde resin useful for the present invention include those described in U.S. Pat. No. 5,486,219 (Ford et al.), incorporated herein by reference.

A particularly preferred urea-aldehyde resin for use in the present invention is that known under the trade designation "AL3029R", from Borden Chemical. This is an unmodified (i.e. contains no furfural) urea-formaldehyde resin with these characteristics: 65% solids, viscosity (Brookfield, #3 spindle, 30 rpm 25° C.) of 325 cps, a free formaldehyde content of 0.1–0.5%, and a mole ratio of formaldehyde to urea ("F/IU ratio") of ranging from about 1.4:1.0 to about 1.6:1.0.

Urea resin binder precursor systems preferably employ a cocatalyst system. The cocatalyst may consist essentially of a Lewis acid, preferably aluminum chloride ($ACl_3$), and an organic or inorganic salt. A Lewis acid catalyst is defined simply as a compound which accepts an electron pair, and preferably has an aqueous solubility at 15° C. of at least about 50 grams/cc.

Lewis acids (or compounds which behave as Lewis acids) which are preferred are aluminum chloride, iron (III) chloride, and copper (II) chloride. A Lewis acid which is particularly preferred is aluminum chloride in either its non-hydrated form ($AlCl_3$) or hexahydrate from ($AlCl_3.6H_2O$).

The Lewis acid is typically and preferably used in the binder precursor system at an amount ranging from about 0.1 to about 5.0 weight percent of the total weight of binder precursor, as a 20–30% solids aqueous solution. If aluminum chloride ($AlCl_3$) is used, it has been found that 0.6 weight percent of a 28% solids aqueous solution of $AlCl_3$ gives preferable results.

Acrylate resins include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate, as well as these unsaturated monomers, for example, styrene, divinylbenzene, vinyl toluene.

Acrylated isocyanurates are isocyanurate derivatives having at least one pendant acrylate group, which are further described in U.S. Pat. No. 4,652,274 (Boettcher et al.), incorporated herein by reference. A preferred acrylated isocyanurate is the triacrylate of tris(hydroxyethyl) isocyanurate.

Acrylated urethanes are diacrylate esters of hydroxy terminated isocyanate extended polyesters or polyethers. Examples of commercially available acrylated urethanes include those available under the trade designations, "UVITHANE 782", "CMD 6600", "CMD 8400", and "CMD 8805", from Radcure Specialties, Inc., Atlanta, Ga.

Acrylated epoxies are monoacrylate and diacrylate esters of epoxy resins, such as the diacrylate esters of bisphenol A epoxy resin. Examples of commercially available acrylated epoxies include "CMD 3500", "CMD 3600", and "CMD 3700", available from Radcure Specialties, Inc., Atlanta, Ga.

Bismaleimide resins are further described in the assignee's U.S. Pat. No. 5,314,513, which is incorporated herein by reference.

In addition to thermosetting resins, a hot melt resin may also be used. For example, a binder precursor system may comprise a hot melt pressure sensitive adhesive which can be energy cured to provide a binder. In this instance, because the binder precursor is a hot melt composition, it is particularly useful with porous cloth, textile or fabric backings. Since this binder precursor does not penetrate the interstices of the porous backing, the natural flexibility and pliability of the backing is preserved. Exemplary hot melt resins are described in U.S. Pat. No. 5,436,063 (Follett et al.), incorporated herein by reference.

The hot melt binder precursor system may comprise an epoxy-containing material, a polyester component, and an effective amount of an initiator for energy curing the binder. More particularly, the binder precursor can comprise from about 2 to 95 parts of the epoxy-containing material and, correspondingly, from about 98 to 5 parts of the polyester component, as well as the initiator. An optional hydroxyl-containing material having a hydroxyl functionality greater than 1 may also be included.

Preferably, the polyester component has a Brookfield viscosity which exceeds 10,000 millipascals at 121° C. to 200,000, more preferably from about 10,000 to 50,000, and most preferably from about 15,000 to 30,000. The polyester component may be the reaction product of a dicarboxylic acid selected from the group consisting of saturated aliphatic dicarboxylic acids containing from 4 to 12 carbon atoms (and diester derivatives thereof) and aromatic dicarboxylic acids containing from 8 to 15 carbon atoms (and diester derivatives thereof) and (b) a diol having 2 to 12 carbon atoms.

Abrasive Particles

Abrasive particles useful in the invention can be of any conventional grade utilized in the formation of abrasive articles. Suitable abrasive particles can be formed of, for example, flint, garnet, ceria, aluminum oxide (including fused and heat-treated aluminum oxide), alumina zirconia (including fused alumina zirconia as disclosed, for example, in U.S. Pat. Nos. 3,781,172; 3,891,408; and 3,893,826, and commercially available from the Norton Company of Worcester, Mass., under the trade designation "NorZon"), diamond, silicon carbide (including refractory coated silicon carbide as disclosed, for example, in U.S. Pat. No. 4,505,720 (Gabor et al.)), silicone nitride, alpha alumina-based ceramic material (as disclosed, for example, in U.S. Pat. Nos. 4,518,397 (Leitheiser et al.); 4,574,003 (Gerk et al.); 4,744,802 (Schwabel et al.); 4,770,671 (Monroe et al.); 4,881,951 (Wood et al.); and 5,011,508 (Wald et al.)), titanium diboride, boron carbide, tungsten carbide, titanium carbide, iron oxide, cubic boron nitride, and mixtures thereof. Diamond and cubic boron nitride abrasive in the form of grains may be monocrystalline or polycrystalline.

Abrasive particles may be individual abrasive grains or agglomerates of individual abrasive grains. Abrasive particles may have a particle size ranging from about 0.01 to 1500 micrometers, typically between 1 to 1000 micrometers. As discussed above, abrasive particles having a particle size of from about 0.1 to less than 200 micrometers, typically 0.1 to 120 micrometers, are used frequently for lapping coated abrasives. The frequency (concentration) of the abrasive particles on the backing depends on the desired application and is within the purview of the skilled artisan. The abrasive particles can be oriented or can be applied without orientation, depending upon the requirements of the particular abrasive product.

The abrasive particles may be applied as an open or closed coat. A closed coat is one in which the abrasive particles completely cover the major surface of the backing. In an open coat, the abrasive particles cover from about 20 to 90% of the major surface of the backing, typically from 40 to 70%.

An abrasive article of the present invention may contain a blend of abrasive grains and diluent particles. Diluent particles can be selected from the group consisting of: (1) an inorganic particle (non-abrasive inorganic particle), (2) an organic particle, (3) an abrasive agglomerate containing abrasive grains, (4) a composite diluent particle containing a mixture of inorganic particles and a binder, (5) a composite diluent particle containing a mixture of organic particles and a binder.

Non-abrasive inorganic particles typically include materials having a Moh hardness less than 6. The non-abrasive inorganic particles can include grinding ids, fillers and the like, as described herein.

The particle size of diluent particles can range from about 0.01 to 1500 micrometers, typically between 1 to 1000 micrometers. The diluent particles may have the same particle size and particle size distribution as the abrasive particles. Alternatively, the diluent particles may have a different particle size and particle size distribution.

Optional Additives

Optional additives, such as, for example, fillers (including grinding aids), fibers, antistatic agents, lubricants, wetting agents, surfactants, pigments, dyes, coupling agents, plasticizers, release agents, suspending agents, and curing agents including free radical initiators and photoinitiators, may be included in abrasive articles of the present invention.

In addition, additives may be included to enhance reactivity, crosslinking, and glass transition temperature of the antiloading component, depending on the antiloading component selected; for example, trimethylol propane triacrylate (TMPTA) may be used in addition to the antiloading component, stearyl acrylate, in order to enhance the reaction rate, i.e., copolymerization, heat resistance, and mechanical properties of the stearyl acrylate. In these instances, however, the additive chemistry may require that additional components be included in the binder precursor composition to aid in curing; for example, a photoinitiator may be required when acrylates are used. The amounts of these materials can be selected to provide the properties desired.

Examples of useful fillers for this invention include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide, aluminum oxide, titanium dioxide) and metal sulfites (such as calcium sulfite). Examples of useful fillers also include silicon compounds, such as silica flour, e.g., powdered silica having a particle size of from about 4 to 10 mm (available from Akzo Chemie America, Chicago, Ill.), and calcium salts, such as calcium carbonate and calcium metasilicate (available under the trade designations, "Wollastokup" and "Wollastonite" from Nyco Company, Willsboro, N.Y.).

Examples of antistatic agents include graphite, carbon black, vanadium oxide, humectants, and the like. These antistatic agents are disclosed in U.S. Pat. Nos. 5,061,294; 5,137,542; and 5,203,884; incorporated herein by reference.

A coupling agent can provide an association bridge between the binder and the filler particles. Additionally the coupling agent can provide an association bridge between the binder and the abrasive particles. Examples of coupling agents include silanes, titanates, and zircoaluminates. There are various means to incorporate the coupling agent. For example, the coupling agent may be added directly to the binder precursor. The binder may contain anywhere from about 0.01 to 3% by weight coupling agent. Alternatively, the coupling agent may be applied to the surface of the filler particles. In still another embodiment, the coupling agent is applied to the surface of the abrasive particles prior to being incorporated into the abrasive article. The abrasive particle may contain anywhere from about 0.01 to 3% by weight coupling agent.

Curing agents such as an initiator may be used, for example, when the energy source used to cure or set a binder precursor is heat, ultraviolet light, or visible light in order to generate free radicals. Examples of curing agents such as photoinitiators that generate free radicals upon exposure to ultraviolet light or heat include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. Commercially available photoinitiators include those available from Ciba Geigy Company, Hawthorne, N.Y., under the trade designations "IRGACURE 651" and "IRGACURE 184" and those available from Merck & Company, Incorporated, Rahway, N.J., under the trade designation "DAROCUR 1173" (all of which generate free radicals upon exposure to ultraviolet light) and those available from Ciba Geigy Company, Hawthorne, N.Y., under the trade designation "IRGACURE 369" (which generates free radicals upon exposure to visible light). In addition, initiators which generate free radicals upon exposure to visible light as described in U.S. Pat. No. 4,735,632, which is incorporated herein by reference. Typically, an initiator is used in amounts ranging from about 0.1 to about 10% by weight, preferably 2 to 4%, based on the weight of the binder precursor. It is within the scope of the present invention to use an initiator even if the binder precursor is exposed to an electron beam source.

Antiloading Component

An antiloading component of the present invention is present in a part of the abrasive article which ultimately contacts a workpiece during abrading. For example, an antiloading component may be present in a binder of a size coat or in a peripheral coating, for example, a supersize coat, or both, of a coated abrasive article; a binder of an abrasive composite or a peripheral coating, or both, of a structured abrasive article; a binder of an abrasive coating/layer or a peripheral coating, or both, of a lapping abrasive article; a binder or peripheral coating, or both, of a bonded abrasive article; or a binder or peripheral coating, or both, of a nonwoven abrasive article. Preferably, an antiloading component is present in a peripheral coating.

An antiloading component of the present invention is a compound having a hydrocarbon chain and a polar group.

Antiloading components of the present invention include compounds of any of formulas I to VIII or mixtures thereof:

I

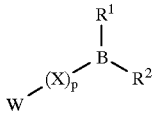

wherein $R^1$ and $R^2$ are independently OH, OR, $O^-$, $NH_2$, NHR, or $N(R)_2$, with the proviso that if either or both of $R^1$ and $R^2$ is $O^-$, then a cation is present, for example, a monovalent cation, $M^+$, may be present if either $R^1$ or $R^2$ is $O^-$, and two monovalent cations, $M^+$, or a divalent cation, $V^{2+}$, may be present if both $R^1$ and $R^2$ are $O^-$; $R^1$ and $R^2$ are independently preferably $O^-$, OH, or $NH_2$, more preferably $O^-$ or OH;

if present, $M^+$ is independently $Li^+$, K+, $Na^+$, $Rb^+$, $Cs^+$, or $N^+(R')_4$, wherein R' is independently hydrogen or an unsubstituted or substituted alkyl group, preferably $CH_3$, $CH_2CH_3$, or $CH_2CH_2OH$; preferably $M^+$ is $K^+$ or $Na^+$;

if present, $V^{2+}$ is $Ca^{2+}$, $Mg^{2+}$, $Ba^{2+}$, $Zn^{2+}$, $Sr^+$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$, or $Zr^{2+}$, preferably $Ca^{2+}$, $Mg^{2+}$, or $Zn^{2+}$;

R is an alkyl group, preferably $C_nH_{2n+1}$ where n is 1 to 30, preferably 1 to 10, more preferably 1 to 2;

X is O, S, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, X is preferably O or NH, more preferably O;

p is 0 or 1, preferably 1; and

W is an alkyl group, which may be saturated or unsaturated, preferably W has a formula $C_nH_{2n+1}$ where n is 10 to 100, preferably 12 to 30, more preferably 18 to 22, or W is a fluorinated hydrocarbon having a formula $C_mH_aF_{2m+1-a}$ where a is 0 to 2m and m is 4 to 50, preferably 6 to 30, more preferably 8 to 20, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon, i.e., 1 to n/2 in the case of $C_nH_{2n+1}$ or 1 to m/2 in the case of $C_mH_aF_{2m+1-a}$;

if only one boron compound of formula I is present and a salt is formed, i.e., either one or both of $R^1$ and $R^2$ are $O^-$ and a cation or cations are present, these cations are not limited to $M^+$ and $V^{2+}$; in other words, a cation or combination of cations may be present such that their cumulative positive charge equals the cumulative negative charge of the one boron compound, for example, a metallic cation or quaternary ammonium, tertiary ammonium, secondary ammonium, or primary ammonium cation with a positive charge equaling the cumulative negative charge of the boron compound may be present instead of $M^+$ and $V^{2+}$; alternatively, these cations may be present in addition to $M^+$ and $V^{2+}$ such that the cumulative positive charge of all of the cations equals the cumulative negative charge of the boron compound;

if two or more boron compounds of formula I are mixed together and, in the two or more boron compounds, $R^1$ and/or $R^2$ is $O^-$, a metallic cation or quaternary ammonium, tertiary ammonium, secondary ammonium, or primary ammonium cation with a positive charge equaling the cumulative negative charge of the boron compounds may be present instead of $M^+$ and $V^{2+}$; alternatively, these cations may be present in addition to $M^+$ and $V^{2+}$ such that the cumulative positive charge of all of the cations equals the cumulative negative charge of the boron compounds;

II

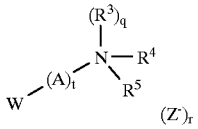

wherein $R^3$ is OH;

q is 0 or 1;

$Z^-$ is a monovalent anion, for example, $H_2PO_4^-$, $HSO_4^-$, $NO_3^-$, $Cl^-$, $Br^-$, $I^-$, $F^-$, $CH_3SO_4$, $H_2PO_3^-$, $C_nH_{2n-1}OPO_3H^-$, $C_nH_{2n+1}PO_3H^-$, wherein n is 1 to 100, preferably 1 to 30, more preferably 10 to 20; preferably $Z^-$ is $H_2PO_4^-$, $H_2PO_3^-$, $HSO_4^-$, or $CH_3SO_4^-$, more preferably $H_2PO_4^-$ or $H_2PO_3^-$;

r is 0 or 1, with the proviso that when q is 0, r is 0 and when q is 1, r is 1 and when q and r are 1, N carries a positive charge;

$R^4$ and $R^5$ independently are H or an alkyl group, preferably $C_nH_{2n+1}$ where n is 1 to 30, preferably 1 to 10, more preferably 1 to 2;

A is a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, with the proviso that the linking group is connected by a carbon atom to N of formula II; when t=1, preferably A is C(=O), C(=O)$CH_2$, NHC(=O), OC(=O), $OCH_2$, $OCH_2CH_2$, or $OCH(CH_3)CH_2$;

t is 0 or 1, preferably 0; and

W is an alkyl group, which may be saturated or unsaturated, preferably W has a formula $C_nH_{2n+1}$ where n is 10 to 100, preferably 12 to 30, more preferably 18 to 22, or W is a fluorinated hydrocarbon having a formula $C_mH_aF_{2m+1-a}$ where a is 0 to 2m and m is 4 to 50, preferably 6 to 30, more preferably 8 to 20, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon, i.e., 1 to n/2 in the case of $C_nH_{2n+1}$ or 1 to m/2 in the case of $C_mH_aF_{2m+1-a}$;

III

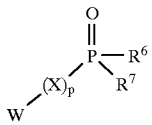

wherein $R^6$ and $R^7$ independently are $O^-$, OH, OR, $NH_2$, NHR, or $N(R)_2$, with the proviso that both $R^6$ and $R^7$ cannot be OH simultaneously or OR simultaneously, and one of $R^6$ and $R^7$ cannot be OH when the other of $R^6$ and $R^7$ is OR, and with the proviso that if either or both of $R^6$ and $R^7$ is $O^-$, a cation is present, for example, a monovalent cation, $M^+$, may be present if either $R^6$ or $R^7$ is $O^-$, and two monovalent cations, $M^+$, or a divalent cation, $V^{2+}$, may be present if $R^6$ and $R^7$ are both $O^-$, preferably $R^6$ and $R^7$ are independently $O^-$ or $NH_2$, more preferably $O^-$;

R is an alkyl group, preferably $C_nH_{2n+1}$ where n is 1 to 30, preferably 1 to 10, more preferably 1 to 2;

if present, $M^+$ is independently $Li^+$, $K^+$, $Na^+$, $Rb^+$, $Cs^+$, or $N^+(R')_4$, wherein R' is independently hydrogen or an unsubstituted or substituted alkyl group, preferably $CH_3$, $CH_2CH_3$, or $CH_2CH_2OH$, preferably $M^+$ is $K^+$ or $Na^+$;

if present, $V^{2+}$ is $Ca^{2+}$, $Mg^{2+}$, $Ba^{2+}$, $Zn^{2+}$, $Sr^{2+}$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$, or $Zr^{2+}$, preferably $Ca^{2+}$, $Mg^{2+}$, or $Zn^{2+}$;

X is O, S, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, X is preferably O or NH, more preferably O;

p is 0 or 1, preferably 1; and

W is an alkyl group, which may be saturated or unsaturated, preferably W has a formula $C_nH_{2n+1}$ where n is 10 to 100, preferably 12 to 30, more preferably 18 to 22, or W is a fluorinated hydrocarbon having a formula $C_mH_aF_{2m+1-a}$ where a is 0 to 2m and m is 4 to 50, preferably 6 to 30, more preferably 8 to 20, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon, i.e., 1 to n/2 in the case of $C_nH_{2n+1}$ or 1 to m/2 in the case of $C_mH_aF_{2m+1-a}$;

if only one phosphate compound of formula III is present and a salt is formed, i.e., either one or both of $R^6$ and $R^7$ are $O^-$ and a cation or cations are present, these cations are not limited to $M^+$ and $V^{2+}$; in other words, a cation or combination of cations may be present such that their cumulative positive charge equals the cumulative negative charge of the one phosphate compound, for example, a metallic cation or quaternary ammonium, tertiary ammonium, secondary ammonium, or primary ammonium cation with a positive charge equaling the cumulative negative charge of the phosphate compound may be present instead of $M^+$ and $V^{2+}$; alternatively, these cations may be present in addition to $M^+$ and $V^{2+}$ such that the cumulative positive charge of all of the cations equals the cumulative negative charge of the phosphate compound;

if two or more phosphate compounds of formula III are mixed together and, in the two or more phosphate compounds, $R^6$ and/or $R^7$ is $O^-$, a metallic cation or quaternary ammonium, tertiary ammonium, secondary ammonium, or primary ammonium cation with a positive charge equaling the cumulative negative charge of the phosphate compounds may be present instead of $M^+$ and $V^{2+}$; alternatively, these cations may be present in addition to $M^+$ and $V^{2+}$ such that the cumulative positive charge of all of the cations equals the cumulative negative charge of the phosphate compounds;

IV

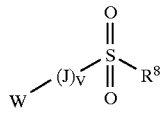

wherein $R^8$ is OH, OR, $O^-$, $NH_2$, NHR, $N(R)_2$, $N(R^9)(R^{10})(OR^{11})$, $N(CH_2CH_3)CH_2CH_2OC(O)CH{=}CH_2$, or

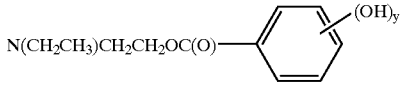

$R^8$ is preferably OH, $O^-$, $NH_2$, more preferably $O^-$;

wherein when $R^8$ is $O^-$, then a cation is present, preferably a monovalent cation, $M^+$;

if present, $M^+$ is independently $Li^+$, $K^+$, $Na^+$, $Rb^+$, $Cs^+$, or $N^+(R')_4$, wherein R' is independently hydrogen or an unsubstituted or substituted alkyl group, preferably $CH_3$, $CH_2CH_3$, or $CH_2CH_2OH$, preferably $M^+$ is $K^+$ or $Na^+$;

R is an alkyl group, preferably $C_nH_{2n+1}$ where n is 1 to 30, preferably 1 to 10, more preferably 1 to 2;

$R^9$ is H, $CH_3$, or $CH_2CH_3$;

$R^{10}$ is $CH_2$or $CH_2CH_2$;

$R^{11}$ is hydrogen or $C(O)CH{=}CH_2$;

J is O, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, J is preferably O, NH, $C({=}O)CH_2$, $OCH_2O$, $OCH_2CH_2O$, $OCH(CH_3)CH_2O$, $OCH_2$, $OCH_2CH_2$, or $OCH(CH_3)CH_2$, more preferably O;

v is 0 or 1;

y is 0 or 1; and

W is an alkyl group, which may be saturated or unsaturated, preferably W has a formula $C_nH_{2n+1}$ where n is 10 to 100, preferably 12 to 30, more preferably 18 to 22, or W is a fluorinated hydrocarbon having a formula $C_mH_aF_{2m+1-a}$ where a is 0 to 2m and m is 4 to 50, preferably 6 to 30, more preferably 8 to 20, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon, i.e., 1 to n/2 in the case of $C_nH_{2n+1}$ or 1 to m/2 in the case of $C_mH_aF_{2m+1-a}$;

$$W\text{-}(A)_t\text{-}D \qquad V$$

wherein D is a monovalent radical including any of:

$$\text{—}OH,\ \text{—}N{=}C{=}O,\ \text{—}CO_2H,$$

$$\text{—}NR^{12}C(O)NR^{13}R^{14},\ \text{—}C(O)NR^{15}R^{16},$$

-continued $OC(O)C(CH_2—CO_2H)_2(OH)$, $(—OOCCH_2)(HO_2C)C(OH)(CH_2CO_2H)$,

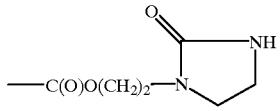

$—NR^{12}C(O)(CH_2)_2CO_2H$, $—NR^{12}C(O)(CH_2)_3OH$, $—NHC(O)OR^{17}$, $—NR^{12}C(O)(CH_2)_2C(O)OR^{17}$, $—NR^{12}C(O)(CH{=}CH)C(O)OR^{17}$,

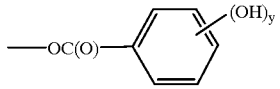

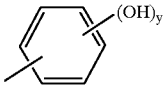

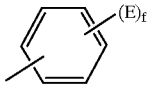

$—QC(O)C(R^{18}){=}CH_2$,

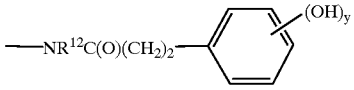

wherein if y is 1, OH is in an ortho position,

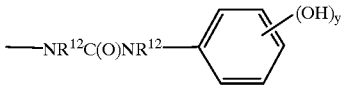

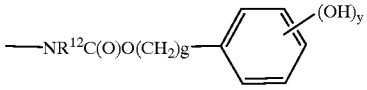

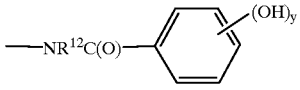

$—NR^{12}C(O)C(CH_3)_2NHC(O)CH{=}CH_2$,

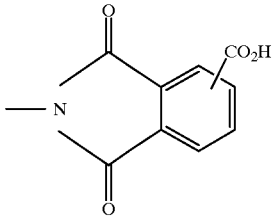

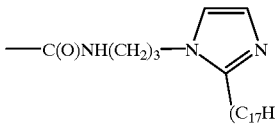

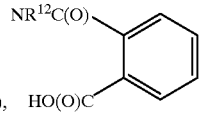

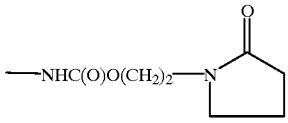

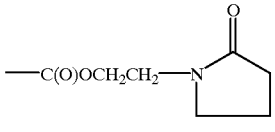

and

-continued

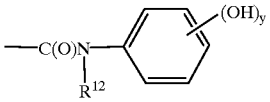

preferably D is $C(O)NR^{15}R^{16}$, $OC)O)C(CH_2—CO_2H)_2(OH)$, or $(HO_2C)C(OH)(CH_2CO_2H)(CH_2COO)$, more preferably D is $C(O)NR^{15}R^{16}$;

$R^{12}$ is hydrogen or an alkyl group having from one to four carbon atoms, $R^{13}$ and $R^{14}$ independently are hydrogen, an alkyl group, preferably $C_nH_{2n+1}$ where n is 1 to 30, preferably 1 to 10, more preferably 1 to 2, or an aliphatic group, which is substituted or unsubstituted, for example, with an aromatic group, wherein the aliphatic group has 20 atoms or less and contains carbon and, optionally, nitrogen, oxygen, phosphorus, and/or sulfur in the aliphatic group or as a substituent to the aliphatic group;

$R^{15}$ and $R^{16}$ independently are hydrogen or an alkyl group, preferably $C_nH_{2n+1}$ where n is 1 to 30, preferably 1 to 10, more preferably 1 to 2;

$R^{17}$ is hydrogen or an alkyl group which may be saturated or unsaturated, preferably $C_nH_{2n+1}$ or $C_nH_{2n}$ where n is 1 to 30, preferably 1 to 18, more preferably 1 to 10;

$R^{18}$ is hydrogen or $C_nH_{2n+1}$ where n is 1 to 8;

E is independently COOH or $COO^-$, wherein when one or two $COO^-$ groups is present, a cation is present, preferably, a monovalent cation, $M^+$, is present when one $COO^-$ group is present and either two $M^+$ are present or $V^{2+}$ is present when two $COO^-$ groups are present;

if present, $M^+$ is independently $Li^+$, $K^+$, $Na^+$, $Rb^+$, $Cs^+$, or $N^+(R')_4$, wherein R' is independently hydrogen or an unsubstituted or substituted alkyl group, preferably $CH_3$, $CH_2CH_3$, or $CH_2CH_2OH$, preferably $M^+$ is $K^+$ or $Na^+$;

if present, $V^{2+}$ is independently $Ca^{2+}$, $Mg^{2+}$, $Ba^{2+}$, $Zn^{2+}$, $Sr^{2+}$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$, or $Zr^{2+}$, preferably $Ca^{2+}$, $Mg^{2+}$, or $Zn^{2+}$;

Q is O or NH;

R is an alkyl group, preferably $C_nH_{2n+1}$ where n is 1 to 30, preferably 1 to 10, more preferably 1 to 2;

y is 1 to 3;

f is 1 or 2;

g is 1 to 6;

k is 0 or 1;

A is a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, with the proviso that when D is OH, N=C=O, or $NHC(O)NH_2$, the atom of A closest to D is a carbon atom; when t=1, preferably A is C(=O), $C(=O)CH_2$, NHC(=O), OC(=O), $OCH_2$, $OCH_2CH_2$, or $OCH(CH_3)CH_2$;

t is 0 or 1, preferably 0; and

W is an alkyl group, which may be saturated or unsaturated, preferably W has a formula $C_nH_{2n+1}$ where n is 10 to 100, preferably 12 to 30, more preferably 18 to 22, or W is a fluorinated hydrocarbon having a formula $C_mH_aF_{2m+1-a}$ where a is 0 to 2m and m is 4 to 50, preferably 6 to 30, more preferably 8 to 20, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon, i.e., 1 to n/2 in the case of $C_nH_{2n+1}$ or 1 to m/2 in the case of $C_mH_aF_{2m+1-a}$;

VI

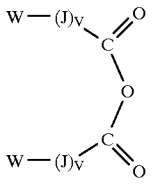

J is O, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, with the proviso that when J is a divalent aliphatic or aromatic linking group, the linking group is connected by a carbon atom to the C of formula VI;

v is 0 or 1, preferably 0; and

W is an alkyl group, which may be saturated or unsaturated, preferably W has a formula $C_nH_{2n+1}$ where n is 10 to 100, preferably 12 to 30, more preferably 18 to 22, or W is a fluorinated hydrocarbon having a formula $C_mH_aF_{2m+1-a}$ where a is 0 to 2m and m is 4 to 50, preferably 6 to 30, more preferably 8 to 20, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon, i.e., 1 to n/2 in the case of $C_nH_{2n+1}$ or 1 to m/2 in the case of $C_mH_aF_{2m+1-a}$;

VII

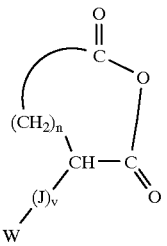

J is O, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, J is preferably O, NH, $C(=O)CH_2$, $OCH_2O$, $OCH_2CH_2O$, $OCH(CH_3)CH_2O$, $OCH_2$, $OCH_2CH_2$, or $OCH(CH_3)CH_2$, more preferably O;

n is an integer ranging from 1 to 5, preferably 1; wherein when n=1, one double bond may be present in the ring (i.e., $(CH_2)_1$—CH becomes CH=C) and when n=2 to 5, one or two double bonds may be present in the ring (i.e., either two (one double bond) or four hydrogen atoms (two double bonds) are omitted from what would be depicted in formula VII without unsaturation);

v is 0 or 1, preferably 0; and

W is an alkyl group, which may be saturated or unsaturated, preferably W has a formula $C_nH_{2n+1}$ where n is 10 to 100, preferably 12 to 30, more preferably 18 to 22, or W is a fluorinated hydrocarbon having a formula $C_mH_aF_{2m+1-a}$ where a is 0 to 2m and m is 4 to 50, preferably 6 to 30, more preferably 8 to 20, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon, i.e., 1 to n/2 in the case of $C_nH_{2n+1}$ or 1 to m/2 in the case of $C_mH_aF_{2m+1-a}$;

VIII

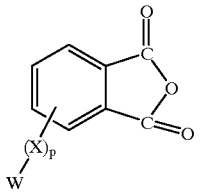

wherein X is O, S, NH, or a divalent aliphatic (including linear, branched, and cycloaliphatic) or aromatic linking group having 20 atoms or less and containing carbon and, optionally, nitrogen, oxygen, phosphorus, and/or sulfur in the aliphatic or aromatic group or as a substituent to the aliphatic or aromatic group, X is preferably O or NH, more preferably O;

p is 0 or 1; and

W is an alkyl group, which may be saturated or unsaturated, preferably W has a formula $C_nH_{2n+1}$, where n is 10 to 100, preferably 12 to 30, more preferably 18 to 22, or W is a fluorinated hydrocarbon having a formula $C_mH_aF_{2m+1-a}$ where a is 0 to 2m and m is 4 to 50, preferably 6 to 30, more preferably 8 to 20, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon, i.e., 1 to n/2 in the case of $C_nH_{2n+1}$ or 1 to m/2 in the case of $C_mH_aF_{2m+1-a}$.

In any of the formulas of the present invention where a salt is formed and a compound of one of the formulas has a cumulative negative charge without any corresponding cation(s), a corresponding cation or cations are present so that its or their cumulative positive charge equals the cumulative negative charge of the compound of the formula. The cation or cations are not limited to $M^+$ and $V^{2+}$ as described above. In other words, a cation or combination of cations may be present such that their cumulative positive charge equals the cumulative negative charge of the compound of the formula. For example, a metallic cation or quaternary ammonium, tertiary ammonium, secondary ammonium, or primary ammonium cation with a positive charge equaling the cumulative negative charge of the compound of the formula may be present instead of $M^+$ and $V^{2+}$; alternatively, these cations may be present in addition to $M^+$ and $V^{2+}$ such that the cumulative positive charge of all of the cations equals the cumulative negative charge of the compound of the formula. This is also true for mixtures of compounds of formulas of the present invention.

The selection and location of an antiloading component of the present invention will depend, in part, upon the desired abrading application. For example, in disc sanding or sheet sanding, which are typically used with hand tools for sanding paint, the antiloading component may be put into the peripheral portion of a coated abrasive article, preferably a supersize coat or size coat if a supersize coat is not present. In this application, the antiloading component of the present invention preferably is any of octadecyl borate, potassium octadecyl borate, octadecyldimethyl borate, docosyl borate, potassium docosyl borate, octadecyldimethylhydroxyammonium phosphate, octadecyldimethylhydroxyammonium phosphite, docosyldimethylhydroxyammonium phosphate, docosyldimethylhydroxyammonium phosphite, potassium octadecyl phosphate, potassium docosyl phosphate, sodium octadecyl phosphate, sodium docosyl phosphate, potassium hexadecyl phosphate, potassium octadecyl phosphonate, potassium tetradecyl phosphonate, sodium octadecyl sulfonate, sodium octadecyl sulfate, sodium docosyl sulfonate, sodium docosyl sulfate, octacosanoic acid, hexacosanoic acid, octadecyl urea, stearyl citrate, stearic anhydride, docosanoic anhydride, octacosanoic anhydride, octadecyl succinic anhydride, docosyl succinic anhydride, octadecyl glutaric anhydride, docosyl glutaric anhydride, octadecyl maleic anhydride, docosyl maleic anhydride, hexadecyl phthalic anhydride, octadecyl phthalic anhydride, and docosyl phthalic anhydride. In this application, the antiloading component more preferably is any of potassium octadecyl borate, potassium docosyl borate, docosyldimethylhydroxyammonium phosphate, docosyldimethylhydroxyammonium phosphite, potassium octadecyl phosphate, potassium docosyl phosphate, sodium docosyl sulfonate, sodium docosyl sulfate, octacosanoic acid, stearyl citrate, docosanoic anhydride, docosyl succinic anhydride, docosyl glutaric anhydride, and docosyl phthalic anhydride.

A second abrading application is belt sanding of wood or wood-like substrates, for example, particle board. In this application, it is preferred to put the antiloading component of the present invention in a binder of a size coat of a coated abrasive article, which may or may not have a supersize coat. In this application, the antiloading component of the present invention preferably is any of 2-(1-imidazolidinonyl)ethyl oleate, 2-(1-pyrrolidinonyl)ethyl oleate, 2-(1-imidazolidinonyl)ethyl-N-stearyl carbamate, 2-(1-pyrrolidinonyl)ethyl-N-stearyl carbamate, N-oleylsuccinamic acid, N-stearylsuccinamic acid, N,N'-distearyl urea, N-stearylurea, N-(hyroxethyl)-N'-stearyl urea, N,N-bis(hydroxyethyl)-N'-stearyl urea, N-(2-hydroxyethyl)aminoethyl-N'-stearyl urea, N-octadecyl-4-hydroxybutanamide, N-oleyl-4-hydroxybutanamide, N-(3-aminomethyl)phenylmethyl-N'-stearyl urea, oleyl N-stearyl carbamate, N-oleyl-N'-stearyl urea, N-oleylmaleamic acid, oleyl amine, N-tris(hydroxymethyl)ethyl-N'-stearyl urea, stearyl 4-hydroxybenzoate, oleyl 4-hydroxybenzoate, 3-pentadecylphenol, 3-(2-hydroxyphenyl)-N-stearylpropanamide, N-(4-hydroxyphenyl)-N'-stearyl urea, (2-hydroxyphenyl)methyl N-stearyl carbamate, 2-(N-ethylperfluorooctanesulfonamide)ethyl acrylate, stearyl acrylate, stearyl amine, ethoxylated oleic acid, N-(hydroxymethyl)octadecanamide, 2-hydroxy-N-octadecylbenzamide, 2-acrylamido-2-methyl-N-(octadecyl)propanamide, N-2-(2'-hydroxybenzoyl)ethyl-N-ethyl perfluorooctylsulfonamide, N-(octadecyl)phthalimide, N-(1'-(2'-heptadecyl)imidazoyl)propyl)octadecanamide, N-(1'-(imidazoyl)propyl)octadecanamide, N-(1'-(imidazoyl)propyl)-N'-octadecyl urea, N-(octadecyl)maleamic acid, 2-carboxy-N-(octadecyl)benzamide, 4-carboxy-N-(octadecyl)phthalimide, N-(2-(1'-pyrrolidinonyl)ethyl)-N'-octadecyl carbamate, and N-(2-(1'-morpholinoyl)ethyl)-N'-octadecyl carbamate.

The description of selection and location of antiloading components of the present invention is merely representative and the present invention is not so limited. Various other selections and locations of an antiloading component of the present invention may be used.

Antiloading Component in a Binder System of an Abrasive Article

As described herein, an antiloading component of the present invention may be present in a binder of an abrasive article. It is within the scope of the present invention to incorporate the antiloading component in a binder wherein initially during abrading the antiloading component is not exposed to the workpiece; however, sometime during abrading, the antiloading component is exposed to and contacts the workpiece. It is preferable that the antiloading component is in a peripheral portion of the abrasive article capable of contacting a workpiece at the beginning of the abrading process. Thus, preferably, an antiloading component is present in a size coat (traditional make/size construction), a make coat (if no size is present), an abrasive coating (lapping abrasive article), or an abrasive composite (structured abrasive article) of various coated abrasive articles or a binder of a bonded or nonwoven abrasive article, all of which have been described herein. The amount of antiloading component in a binder of an abrasive article generally ranges from about 1 to 95% by weight, typically 1 to 75%, preferably 1 to 50%, based on the total dry weight of the binder and any optional additives, i.e., the binder composition.

A method of providing such a component in a binder of an abrasive article is described herein.

Antiloading Component in a Peripheral Coating

An antiloading component may also be present in a peripheral coating if such a coating is present in an abrasive article. Thus, the peripheral coating may be present over a size coat, if a make coat and a size coat are present; over an abrasive coating; over abrasive composites; or over binders of a nonwoven or bonded abrasive article.

A peripheral coating is prepared from a peripheral composition comprising an antiloading component of the present invention. The peripheral composition may contain 100% by weight antiloading component, antiloading component and a binder precursor, or antiloading component and a liquid medium. Generally, the amount of antiloading component in a peripheral coating ranges from about 10 to 100% by weight, typically 50 to 100%, preferably 75 to 100%, more preferably 95 to 100%, based on the dry coating weight of the peripheral coating.

Of course, any embodiment may also contain optional additives such as surfactants, plasticizers, anti-static agents, wetting agents, anti-foaming agents, dyes, pigments, and fillers. Typical examples of fillers are talc, silica, silicates and metal carbonates. These additives may be present in an amount to provide the desired benefit from the additive and should not affect loading properties achieved by the present invention.

The peripheral coating may comprise, in addition to the antiloading component of the present invention, an additional conventional antiloading component. Examples of conventional antiloading components include metal salts of fatty acids, for example zinc stearate, calcium stearate, and lithium stearate; waxes; graphite; and the like.

Method of Applying an Antiloading Component

When present in a binder system of an abrasive article, an antiloading component of the present invention may be combined with a binder precursor (for example, a make coat precursor (if no size coat is present) or a size coat binder precursor), provided that the binder, formed from the binder precursor, ultimately contacts a workpiece during abrading. The combination can then be applied by any suitable coating technique, for example, roll coating, spray coating, knife coating, hot melt coating, curtain coating and the like. The binder precursor is then cured or solidified in a manner described herein for preparation of an abrasive article.

Alternatively, an antiloading component may be present in a peripheral coating. In this embodiment, a peripheral composition comprising the antiloading component is prepared. The peripheral composition may also include a liquid medium such as water or an organic solvent or a binder precursor.

In general, a peripheral composition comprising water or organic solvent may comprise from about 1 to about 100% by weight, preferably 10 to 60% by weight, more preferably 15 to 40% by weight, antiloading component, and from about 0 to about 99% by weight water or organic solvent, preferably 40 to 90% by weight, more preferably 60 to 85% by weight, on a wet weight basis.

When the peripheral composition comprises a binder precursor, the peripheral composition may comprise from about 80 to about 99% by weight, preferably 90 to 99% by weight, more preferably 95 to 99% by weight, antiloading component, and from about 1 to about 20% by weight binder precursor, preferably 1 to 10% by weight, more preferably 1 to 5% by weight, on a dry weight basis.

The peripheral composition may be liquid-free or binder precursor-free. The terms "liquid-free" or "binder precursor-free" as used herein refer to less than 1 weight % liquid medium or binder precursor, respectively, that is, an essentially 100% antiloading component system, with the exception that optional additives may be included.

A method of applying a peripheral composition comprising 100% antiloading component (or antiloading component plus optional additives) which is liquid-free and binder precursor-free includes melting the composition to form a hot melt composition, coating the composition, for example, by spray coating, and cooling at room temperature (about 25° C.) for 5 to 10 minutes. Alternatively, a peripheral composition comprising 100% antiloading component (or antiloading component plus option additives) may be applied by extrusion coating where the temperature of the extruder melts the peripheral composition and then a die coater is used to apply the peripheral composition. The peripheral composition is then cooled at room temperature (about 25° C.) for 5 to 10 minutes.

If it is desired to add a binder precursor, the antiloading component may be combined with a binder precursor to form a peripheral composition and applied in manner generally used to apply binder precursors, for example, roll coating, curtain coating, die coating, spray coating, and the like, and cured in a manner generally used to apply binder precursors, for example, heat, irradiation, and the like. Typically, in this embodiment, the antiloading component may be combined first with a liquid medium including water or an organic solvent before combination with the binder precursor.

Suitable binder precursors include phenolic resins, aminoplast resins having pendant α,β-unsaturated carbonyl groups, urethane resins, epoxy resins, urea-formaldehyde resins, isocyanurate resins, melamine-formaldehyde resins, acrylate resins, acrylated isocyanurate resins, acrylated urethane resins, acrylated epoxy resins, bismaleimide resins, hide glue, cellulosics, latices (for example, polyacrylonitrile-butadiene rubber latex), styrenated acrylic emulsion polymer, casein, soy proteins, sodium alginate, polyvinyl alcohol, polyvinylacetate, polyacrylester, and polyethylene vinylacetate, polystyrene-butadiene, and mixtures thereof. A preferred binder precursor is a styrenated acrylic emulsion polymer, which is commercially available from S.C. Johnson Polymer, Racine, Wis., under the trade designation "Joncryl 1908". Generally, the amount of binder precursor ranges from 0.1 to 90% by weight, preferably 0.1 to 75% by weight, more preferably 0.1 to 50% by weight, based on the weight of the binder precursor composition or the peripheral composition. In another embodiment, an antiloading component of the present invention can be combined with a liquid medium including water and organic solvents to form a peripheral composition. The antiloading component can form a solution with the liquid medium or can exist as a dispersion in the liquid medium. A preferred application comprises, as a peripheral composition, a dispersion of an antiloading component in water, preferably deionized water, or in THF. The liquid medium generally is present in an amount ranging from about 0 to about 99% by weight, preferably 40 to 90% by weight, more preferably 60 to 85% by weight, based on the total wet weight of the peripheral composition.

The peripheral composition comprising an antiloading component and liquid medium can be applied by brushing or coating the composition on an abrasive article, for example, by roll coating, curtain coating, die coating, spray coating, and the like, and then solidified, e.g., dried, at a temperature which depends on whether a liquid medium is present, the liquid medium selected and the amount of liquid medium. For example, the temperature generally ranges from about 20 to 120° C., typically 60–120° C., preferably 80–100° C., for a period of time generally ranging from about 3 minutes to 30 hours, typically from about 5 minutes to 10 hours, preferably 10 minutes to two hours. In most instances, the peripheral composition is dried in a drying oven.

If a binder precursor is present, the steps used to cure or solidify a binder precursor used to form other parts of an abrasive article, for example, a size coat binder precursor, can be utilized. For example, after a peripheral composition comprising an antiloading component and a binder precursor is applied, for example, by roll coating, curtain coating, die coating, spray coating, and the like, the peripheral composition can be solidified or cured by an energy source, for example, heat or irradiation.

Suitable organic solvents include tetrahydrofuran, acetone, methyl ethyl ketone, toluene, methyl isobutyl ketone, ethanol, isopropanol, methanol, glycol ethers, and the like.

The dry coating weight of the peripheral coating in any embodiment depends upon the coated abrasive grade, that is the particle size of the abrasive particle. Typically, the coarser or the larger the abrasive particle is, the higher the coating weight will be. For a given grade, if the coating weight is too high, the abrasive particles may be hidden by the peripheral coating. If the coating weight is too low, then the optimal performance of the resulting abrasive article may be achieved. For example, as a guideline, a coating weight of about 4 to about 12 g/m$^2$ may be used with grade P400 abrasive particles; a coating weight of about 5 to about 15 g/m$^2$ may be used with grade P320 abrasive particles; a coating weight of about 7 to about 25 g/m$^2$ may be used with grade P180 abrasive particles; and a coating weight of about 9 to about 30 g/m$^2$ may be used with grade P120 abrasive particles.

Methods of Using Abrasive Articles

An abrasive article of the present invention can be used for abrading various workpieces or substrates including wood; wood-like materials such as fiber board and particle board; fiberglass; varnishes; polyester coatings; stained surfaces; automotive body filler; ceramics; glass; paint including latex paint, oil paint, and automotive paint; primers including oil-based primers, water-based primers, and e-coat automotive primers; and metals including aluminum, stainless steel, and mild steel. As used herein the term "abrading" refer to grinding, polishing, surface removal, surface finishing, and the like.

A method of abrading a workpiece includes contacting the workpiece with a peripheral portion or surface of an abrasive article, with sufficient force (typically more than about 0.02 kg/cm$^2$) to abrade the workpiece while the peripheral portion or surface and workpiece are moving in relation to each other. Either the workpiece or the abrasive article may be stationary.

As described herein, a coated abrasive can be in the form of a belt, disc, sheet, or the like. In embodiments in which the abrasive article is a continuous abrasive belt, the choice of contact wheel, force employed, and abrasive belt speed depends on the desired rate of cut and the resulting surface finish on the workpiece, care being taken not to damage the workpiece. The contact wheel may be plain or serrated. The force between the abrasive article and the workpiece may range from 0.02 kg/cm to 60 kg/cm, typically and preferably from about 0.04 kg/cm to about 40 kg/cm. The belt speed may range from 300 meters per minute (m/min) to 3,100 m/min, more typically and preferably from about 900 m/min to about 2,200 m/min.

EXAMPLES

Test Methods

Schiefer Test

This test provides a measure of the cut (material removed from a workpiece) of coated abrasive articles under dry conditions (about 22° C. and about 45% Relative Humidity).

A 10.2 cm diameter circular disc was cut from the abrasive material tested and secured by a pressure-sensitive double adhesive tape (commercially available from Minnesota Mining and Manufacturing Company, St. Paul, Minn., under the trade designation "3M Industrial Tape #442") to a back-up pad. The back-up pad was secured to the driven plate of a Schiefer Abrasion Tester (available from Frazier Precision Company, Gaithersburg, Maryland). Doughnut shaped cellulose acetate butyrate polymer workpieces, 10.2 cm outside diameter, 5.24 inside diameter, 1.27 cm thick, available from Seelye Plastics, Minneapolis, Minn., were employed as workpieces. The initial weight of each workpiece was recorded to the nearest milligram prior to mounting on the workpiece holder of the abrasion tester. A 4.5 kg weight was placed on the abrasion tester weight platform and the mounted abrasive specimen lowered onto the workpiece and the machine turned on. The machine was set to run for 500 cycles and then automatically stopped. After each 500 cycles of the test, the workpiece was wiped free of debris and weighed. The cumulative cut for each 500-cycle test was the difference between the initial weight before each set of 500 cycles and the weight following each set of 500 cycles. The endpoint of the test was 2,000 cycles.

Dual Action (DA) Sanding Test/Off-Hand Abrasion Test

A paint panel, i.e., a steel substrate with an e-coat, primer, base coat, and clear coat typically used in automotive paints, was abraded in each case with coated abrasives made in accordance with the invention and with coated abrasives as comparative examples. Each coated abrasive had a diameter of 15.2 cm and was attached to a random orbital sander (available under the trade designation "DAQ", from National Detroit, Inc., Rockford, Ill.). The abrading pressure was about 0.2 kg/cm$^2$, while the sander operated at about 60 PSI(@TOOL (413 kPa). The painted panels were purchased from ACT Company of Hillsdale, Mich. The cut in grams was computed in each case by weighing the primer-coated substrate before abrading and after abrading for a predetermined time, for example, 1 or 3 minutes.

Woodsanding Normal Force Test

Loading of sawdust frequently occurs during wood sanding with an abrasive belt which subsequently leads to burning of the sawdust on the abrasive surface of the belt as well as burning on the sanding path of the wood workpiece adjacent to the burning on the abrasive surface of the belt. Burning of the wood workpiece surface is not an aesthetically desired result since it is counterproductive to providing an attractive wood surface. In addition, burning of loaded sawdust on the abrasive surface of the belt surface renders the abrasive belt useless and, during experimental testing, is usually referred to as an experimental endpoint. The anti-loading size components of the present invention are designed to prevent or minimize or delay loading of sawdust.

In order to determine antiloading properties in the context of sanding a wood or wood-like substrate, a Woodsanding Normal Force Test was conducted. Coated abrasives described in the section for Examples 30 to 33 and Comparative Example I were converted to 168 cm by 7.6 cm continuous belts and installed on an ELB reciprocating bed grinding machine available from ELB Grinders Corp., Mountainside, N.J., under the trade designation "ELB Type SPA 2030ND".

The effective cutting area of the abrasive belt was 7.6 cm by 168 cm. The workpiece abraded by these belts was particle board of these dimensions: 1.6 cm width by 38 cm length by 28 cm height. Abrading was conducted along the 1.6 cm by 38 cm edge. The particle board workpiece was mounted on a reciprocating table. The speed of the abrasive belt was 1,525 rpm. The table speed, at which the workpiece traversed, was 12.2 meters per minute. The downfeed increment of the abrasive belt varied from 0.25 to 2.0 mm/pass of the workpiece and many times the downfeed increment was increased after each 12.2 cm of particle board sanded until the belt failed by loading which precedes burning of the loaded sawdust. The process used was conventional surface grinding wherein the workpiece was reciprocated beneath the rotating abrasive belt with incremental downfeeding between each pass. This grinding was carried out dry.

The normal force ($F_n$) was monitored near the end of sanding each 12.2 cm segment of particle board. As sanding proceeds, the normal force increases. In -general, the lower the normal force, the better the belt is performing the sanding of the workpiece. Saw dust loading leads to both higher normal forces and eventually burning of both the loaded sawdust and the workpiece which becomes a "BURNING" end point. The total amount of particle board cut in cm is reported for each abrasive example evaluated.

Materials

The following materials were used in the examples (quotation marks indicate trade designations):

TABLE 1

| Antiloading Component | Preparation or Manufacturer From Which Component Is Commercially Available | Trade Designation (if any) |
|---|---|---|
| $C_{18}H_{37}NH_2$ | Aldrich Chemical Co., Milwaukee, WI | |
| $C_{16}H_{33}NH_2$ | Aldrich Chemical Co., Milwaukee, WI | |
| $(C_{18}H_{37})_2NH$ | Akzo Nobel Chemicals, Chicago, IL | "Armeen 2-18" |
| $C_{17}H_{35}CONH_2$ | Akzo Nobel Chemicals, Chicago, IL | "Armid 18" |
| $C_{27}H_{55}CO_2H$ | Aldrich Chemical Co., Milwaukee, WI | |
| $C_{23}H_{47}CO_2H$ | Aldrich Chemical Co., Milwaukee, WI | |
| $C_{21}H_{43}CO_2H$ | Aldrich Chemical Co., Milwaukee, WI | |
| $C_{19}H_{39}CO_2H$ | Aldrich Chemical Co., Milwaukee, WI | |
| $C_{17}H_{35}CO_2H$ | Aldrich Chemical Co:, Milwaukee, WI | |
| $C_{15}H_{31}CO_2H$ | Aldrich Chemical Co., Milwaukee, WI | |
| $C_{13}H_{27}CO_2H$ | Aldrich Chemical Co., Milwaukee, WI | |
| $C_{11}H_{23}CO_2H$ | Aldrich Chemical Co., Milwaukee, WI | |
| $C_{22}H_{45}OH$ | Aldrich Chemical Co., Milwaukee, WI | |
| $C_{20}H_{41}OH$ | Aldrich Chemical Co., Milwaukee, WI | |
| $C_{18}H_{37}OH$ | Aldrich Chemical Co., Milwaukee, WI | |
| $C_{16}H_{33}OH$ | Aldrich Chemical Co., Milwaukee, WI | |
| $C_{14}H_{29}OH$ | Aldrich Chemical Co., Milwaukee, WI | |
| stearic anhydride | Aldrich Chemical Co., Milwaukee, WI | |
| stearyl citrate | Aldrich Chemical Co., Milwaukee, WI | |
| 1,3-octadecylurea | Aldrich Chemical Co., Milwaukee, WI | |
| octadecyl hydrogen phosphate $K^+$ salt[3] | * | |
| octadecyl hydrogen phosphate $Na^+$ salt[3] | * | |
| dodecyl hydrogen phosphate $K^+$ salt[4] | * | |
| octadecyl hydrogen phosphate $K^+$ salt[5] | * | |
| $C_{18}H_{35}NH_2$ | Aldrich Chemical Co., Milwaukee, WI | |
| $C_{18}H_{37}OC(O)CH{=}CH_2$ | Sartomer Company, Exton, PA | "SR257" |
| $C_8F_{17}SO_2N(CH_2CH_3)CH_2CH_2OC(O)CH{=}CH_2$ | Minnesota Mining and Manufacturing Company, St. Paul, MN | "FX-13" |

[3]Derived from an octadecyl dihydrogen phosphate commercially available from Rhone-Poulenc, Cranbury, NJ, under the trade designation "DV4771"
[4]Derived from a dodecyl dihydrogen phosphate commercially available from Rhone-Poulenc, Cranbury, NJ, under the trade designation "DV3999"
[5]Derived from an octadecyl dihydrogen phosphate commercially available from Harcos Chemicals, Inc., Kansas City, KS, under the trade designation "T-Mulz 717-95"
*Preparation description provided below.

PREPARATIONS

Preparation 1

Octadecyl hydrogen phosphate monopotassium salt derived from "DV4771"

Octadecyl phosphate ester, "DV4771", (0.57 Kg) from Rhone-Poulenc was dissolved in tetrahydrofuran ("THF") (4 L) in a 6 L stainless steel beaker fitted with a mechanical stirrer. The stainless steel beaker was in a temperature-controlled water bath. The dissolving of DV4771 in THF was speeded up by raising the temperature to 45° C. After DV4771 was dissolved, the temperature was allowed to drop back to room temperature. While the solution was stirred, KOH (1N in methanol, 1500 ml) was added slowly over 1 hour from a dropping funnel. The final pH was between 5.5 to 6 after the neutralization. The white precipitate was filtered with a filter funnel under reduced pressure and then washed once with 500 ml of THF and then washed twice with one liter of water. The moist white cake in the filter paper was dispersed in water (to make up 10% to 20% solids) in a 6 L stainless steel beaker by a mechanical stirrer. A white dispersion was obtained.

Preparation 2

Dodecyl hydrogen phosphate monopotassium salt derived from "DV3999"

The preparation was the same as Preparation 1 above except "DV3999" (0.42 Kg) replaced "DV4771".

Preparation 3

Octadecyl hydrogen phosphate monosodium salt derived from "DV4771"

The preparation was the same as Preparation 1 above except NaOH (64 g solid) replaced KOH solution.

Preparation 4

Octadecyl hydrogen phosphate monopotassium salt derived from "T-Mulz 717-95"

The preparation was the same as Preparation 1 above except "T-Mulz 717-95" (0.57 Kg) replaced "DV4771".

EXAMPLES

Preparation of Examples 1 to 30

Coated abrasive articles representative of the present invention were prepared by applying an antiloading coating to a coated abrasive disc, lacking a supersize coat, which is commercially available from Minnesota Mining and Manufacturing Company, St. Paul, Minn., under the trade designation "3M 210U Production A weight paper". The antiloading component, the dry coating weight of the coating containing the antiloading component, the disc size, the trade designation for the commercially available coated abrasive disc, and the mineral grade for each example are indicated in Table 2.

The antiloading coatings of Examples 1 to 20 were dissolved in THF solvent (15% solution) and applied to the coated abrasive disc by dropper. The discs were then cured at 90° C. for 20 minutes.

The antiloading coatings of Examples 21 to 29 were combined with water (10% solution) and applied with a brush. The discs were air-dried at room temperature (about

25° C.).

TABLE 2

| Example No. | Antiloading Component | Dry Coating Weight of Antiloading Coating ($g/m^2$) | Disc Size (cm) | Grade of Abrasive |
|---|---|---|---|---|
| 1 | $C_{18}H_{37}NH_2$ | 10.48 | 10 | P320 |
| 2 | $C_{16}H_{33}NH_2$ | 10.48 | 10 | P320 |
| 3 | $(C_{18}H_{37})_2NH$ | 10.48 | 10 | P320 |
| 4 | $C_{17}H_{35}CONH_2$ | 10.48 | 10 | P320 |
| 5 | $C_{27}H_{55}CO_2H$ | 10.48 | 10 | P320 |
| 6 | $C_{23}H_{47}CO_2H$ | 10.48 | 10 | P320 |
| 7 | $C_{21}H_{43}CO_2H$ | 10.48 | 10 | P320 |
| 8 | $C_{19}H_{39}CO_2H$ | 10.48 | 10 | P320 |
| 9 | $C_{17}H_{35}CO_2H$ | 10.48 | 10 | P320 |
| 10 | $C_{15}H_{31}CO_2H$ | 10.48 | 10 | P320 |
| 11 | $C_{13}H_{27}CO_2H$ | 10.48 | 10 | P320 |
| 12 | $C_{11}H_{23}CO_2H$ | 10.48 | 10 | P320 |
| 13 | $C_{22}H_{45}OH$ | 10.48 | 10 | P320 |
| 14 | $C_{20}H_{41}OH$ | 10.48 | 10 | P320 |
| 15 | $C_{18}H_{37}OH$ | 10.48 | 10 | P320 |
| 16 | $C_{16}H_{33}OH$ | 10.48 | 10 | P320 |
| 17 | $C_{14}H_{29}OH$ | 10.48 | 10 | P320 |
| 18 | stearic anhydride | 10.48 | 10 | P320 |
| 19 | stearyl citrate | 10.48 | 10 | P320 |
| 20 | 1,3-octadecylurea | 10.48 | 10 | P320 |
| 21a | Octadecyl hydrogen phosphate $K^+$ salt[3] | 8.38 | 10 | P400 |
| 21b | Octadecyl hydrogen phosphate $K^+$ salt[3] | 8.38 | 10 | P320 |
| 22a | Octadecyl hydrogen phosphate $K^+$ salt[3] | 8.38 | 10 | P400 |
| 22b | Octadecyl hydrogen phosphate $K^+$ salt[3] | 8.38 | 10 | P180 |
| 23a | Dodecyl hydrogen phosphate $K^+$ salt[4] | 8.38 | 10 | P400 |
| 23b | Dodecyl hydrogen phosphate $K^+$ salt[4] | 8.38 | 10 | P320 |
| 24a | Octadecyl hydrogen phosphate $Na^+$ salt[3] | 8.38 | 10 | P400 |
| 24b | Octadecyl hydrogen phosphate $Na^+$ salt[3] | 8.38 | 10 | P320 |
| 25 | Octadecyl hydrogen phosphate $K^+$ salt[3] | 8.38 | 15 | P400 |
| 26a | Octadecyl hydrogen phosphate $K^+$ salt[3] | 8.38 | 15 | P400 |
| 26b | Octadecyl hydrogen phosphate $K^+$ salt[3] | 8.38 | 15 | P180 |
| 27 | Dodecyl hydrogen phosphate $K^+$ salt[4] | 8.38 | 15 | P400 |
| 28 | Octadecyl hydrogen phosphate $Na^+$ salt[3] | 8.38 | 15 | P400 |
| 29 | Octadecyl hydrogen phosphate $K^+$ salt[5] | 8.38 | 15 | P400 |

[3]Derived from an octadecyl dihydrogen phosphate commercially available from Rhone-Poulenc, Cranbury, NJ, under the trade designation "DV4771"
[4]Derived from a dodecyl dihydrogen phosphate commercially available from Rhone-Poulenc, Cranbury, NJ, under the trade designation "DV3999"
[5]Derived from an octadecyl dihydrogen phosphate commercially available from Harcos Chemicals, Inc., Kansas City, KS, under the trade designation "T-Mulz 717-95"

Preparation of Comparative Examples

Comparative Example A was commercially available from Minnesota Mining and Manufacturing Company, St. Paul, Minn., under the trade designation "3M 210U Production A weight paper".

Comparative Examples B, F and H were prepared by applying calcium stearate as a dispersion in water (50% solution), with a paint brush, to a coated abrasive product commercially available from Minnesota Mining and Manufacturing Company, St. Paul, Minn., under the trade designation "3M 210U Production A weight paper," and then drying at 88° C. for 15 minutes. The calcium stearate coating was similar to the calcium stearate coating of the coated abrasive product commercially available from Minnesota Mining and Manufacturing Company, St. Paul, Minn., under the trade designation "3M 216U Production FreCut A weight paper."

Comparative Example D was prepared by applying a plasticized phenolic make coat precursor to an A weight paper backing, then applying fused alumina particles having a grade of P400, partially curing, followed by applying a urea-formaldehyde size coat precursor and then curing, and then overcoating the size coat with calcium stearate and drying as described for Comparative Examples B, F, and H.

TABLE 3

| Comp. Example | Antiloading Component | Dry Coating Weight of Antiloading Coating ($g/m^2$) | Disc Size (cm) | Grade of Abrasive |
|---|---|---|---|---|
| A | none | 0 | 10 | P320 |
| B | calcium stearate | 10.48 | 10 | P320 |
| D | calcium stearate | 8.28 | 10 | P400 |
| F | calcium stearate | 8.38 | 10 | P400 |
| H | calcium stearate | 14.69 | 10 | P180 |

Example 1 to 20 and Comparative Examples A and B

Examples 1 to 20 and Comparative Examples A and B were tested according to the Schiefer Test. Three discs were tested for each example and the average cut every 500 cycles up to and including 2000 cycles were determined. The results are shown in Table 4.

TABLE 4

| Example | Structure | | Schiefer Test Results | | | | | |
|---|---|---|---|---|---|---|---|---|
| | | | Cut After 500 Cycles | Cut After 1000 Cycles | Cut After 1500 Cycles | Total Cut (2000 Cycles) | Cut as % Of | |
| Designation | Chain | Polar Group | (g) | (g) | (g) | (g) | Comp. Ex. A | Loading# |
| Comp. Ex. A | none | none | 0.552 | 0.995 | 1.436 | 1.930 | 100 | 3 |
| Comp. Ex. B | n-$C_{17}H_{35}$ | carboxylate, Ca | 1.399 | 2.690 | 3.977 | 5.188 | 269 | 1 |
| Ex. 1 | n-$C_{18}H_{37}$ | primary amine | 1.658 | 2.785 | 3.749 | 4.351 | 225 | 1.5 |
| Ex. 2 | n-$C_{16}H_{33}$ | primary amine | 1.656 | 2.925 | 3.723 | 4.503 | 233 | 1.5 |
| Ex. 3 | two n-$C_{18}H_{37}$ | secondary amine | 0.85 | 1.704 | 2.538 | 3.287 | 170 | 3 |
| Ex. 4 | n-$C_{17}H_{35}$ | amide | 1.252 | 2.096 | 2.832 | 3.520 | 182 | 2 |
| Ex. 5 | n-$C_{27}H_{55}$ | acid | 1.136 | 2.234 | 3.161 | 3.883 | 201 | 1 |
| Ex. 6 | n-$C_{23}H_{47}$ | acid | 1.316 | 2.428 | 3.176 | 4.121 | 214 | 1.5 |
| Ex. 7 | n-$C_{21}H_{43}$ | acid | 0.342 | 0.823 | 1.321 | 1.789 | 93 | 2 |
| Ex. 8 | n-$C_{19}H_{39}$ | acid | 0.398 | 0.919 | 1.564 | 2.209 | 114 | 3 |
| Ex. 9 | n-$C_{17}H_{35}$ | acid | 0.657 | 1.243 | 1.829 | 2.310 | 120 | 3.5 |
| Ex. 10 | n-$C_{15}H_{31}$ | acid | 0.428 | 0.882 | 1.292 | 1.704 | 88 | 2.5 |
| Ex. 11 | n-$C_{13}H_{27}$ | acid | 0.354 | 0.852 | 1.388 | 1.879 | 97 | 2.5 |
| Ex. 12 | n-$C_{11}H_{23}$ | acid | 0.609 | 1.157 | 1.642 | 2.114 | 110 | 2.5 |
| Ex. 13 | n-$C_{22}H_{45}$ | alcohol | 1.046 | 1.920 | 2.610 | 3.271 | 169 | 1 |
| Ex. 14 | n-$C_{20}H_{41}$ | alcohol | 0.793 | 1.380 | 2.034 | 2.556 | 132 | 1 |
| Ex. 15 | n-$C_{18}H_{37}$ | alcohol | 0.259 | 0.762 | 1.256 | 1.835 | 95 | 2 |
| Ex. 16 | n-$C_{16}H_{33}$ | alcohol | 0.405 | 0.746 | 1.188 | 1.617 | 84 | 3 |
| Ex. 17 | n-$C_{14}H_{29}$ | alcohol | 0.519 | 0.966 | 1.373 | 1.837 | 95 | 3.5 |
| Ex. 18 | two n-$C_{17}H_{35}$ | acid anhydride | 1.059 | 1.798 | 2.453 | 3.034 | 157 | 2 |
| Ex. 19 | n-$C_{17}H_{35}$ | citrate | 1.225 | 2.288 | 3.239 | 4.067 | 211 | 4 |
| Ex. 20 | two n-$C_{18}H_{37}$ | urea | 1.113 | 2.025 | 2.908 | 3.485 | 181 | 2.5 |

#The loading scale is from 1 to 5. 1 is the best with limited loading and 5 is the worst with extensive loading seen visually; the extensive loading usually increases the weight of the abrasive article tested.

Examples 21 to 24 and Comparative Examples B, D, F, and H

Examples 21 to 24 and Comparative Examples B, D, F, and H were tested according the Schiefer Test. Three discs were tested for each example and the average cut after 2000 cycles was determined. The results are shown in Table 5.

TABLE 5

| Example Designation | Cut as a % of Comp. Ex. B | Cut as a % of Comp. Ex. D | Cut as a % of Comp. Ex. F | Cut as a % of Comp. Ex. H |
|---|---|---|---|---|
| Comp. Ex. B | 100 | | | |
| Comp. Ex. D | | 100 | | |
| Comp. Ex. F | | | 100 | |
| Comp. Ex. H | | | | 100 |
| Ex. 21a | N.D. | N.D. | 119 | N.D. |
| Ex. 21b | 130 | N.D. | N.D. | N.D. |
| Ex. 22a | N.D. | 164 | 128 | N.D. |
| Ex. 22b | N.D. | N.D. | N.D. | 117 |
| Ex. 23a | N.D. | N.D. | 104 | N.D. |
| Ex. 23b | 97 | N.D. | N.D. | N.D. |
| Ex. 24a | N.D. | N.D. | 132 | N.D. |
| Ex. 24b | 129 | N.D. | N.D. | N.D. |

N.D. = No data was generated for this comparison.

Examples 25 to 29 and Comparative Examples D, F, and H

Examples 25 to 29 and Comparative Examples D, F, and H were evaluated by the DA Sanding Test. The sanding was conducted down to the e-coat. Three discs were tested for each example and the average cut after 3 minutes of sanding was determined. The results are shown in Table 6.

TABLE 6

| Example Designation | Cut as % Of Comp. Ex. D | Cut as % Of Comp. Ex. F | Cut as % Of Comp. Ex. H |
|---|---|---|---|
| Comp. Ex. D | 100 | | |
| Comp. Ex. F | | 100 | |
| Comp. Ex. H | | | 100 |
| Ex. 25 | N.D. | 130 | N.D. |
| Ex. 26a | 173 | 109 | N.D. |
| Ex. 26b | N.D. | N.D. | 94, 108# |
| Ex. 27 | N.D. | 91 | N.D. |
| Ex. 28 | N.D. | 108 | N.D. |
| Ex. 29 | 150 | N.D. | N.D. |

N.D. = No data was generated for this comparison
#This comparison was conducted twice.

Example 30–33 and Comparative Example I

Comparative Example I was commercially available from Minnesota Mining and Manufacturing Company of St. Paul, Minn. under the trade designation "Grade P100 3M 200D Three-M-Ite Resin Bond Cloth".

Examples 30 to 33 were coated abrasives having a backing of a J weight woven cotton cloth available from Ernstmeier (Herford, Germany) weighing 265 g/m$^2$, which was pretreated by Ernstmeier to prepare the backing for receiving a make coat.

A coatable mixture for producing a make coating for the backing was prepared by mixing 69 parts of 76% solids phenolic resin (48 parts phenolic resin), 52 parts non-agglomerated calcium carbonate filler (dry weight basis), and a solution of 90 parts water/10 parts propylene glycol monomethyl ether to form a make coating which was 84% solids, with a wet coating weight of 71 g/m$^2$. The make coating was applied in each case via knife coating. Next, grade P100 (ANSI standard B74.18 average particles size of 150 micrometers) fused aluminum oxide abrasive particles were electrostatically coated onto the uncured make coating with a weight of 200 g/m$^2$. Then, the resulting constructions received a precure of 15 minutes at 65° C., followed by 75 minutes at 88° C.

A 76% solids coatable phenolic resin mixture suitable for forming a size coating (having a composition described in Table 7) was then applied over the abrasive particles/make coat construction via two-roll coater. The wet size coating weight in each case was about 146 g/m$^2$. In Examples 31 and 32, the wet size coating surfaces were exposed at 4.5 m/min to one 118 watts/cm D bulb to initiate the reaction of the acrylates in these coating formulations. All of Examples 30 to 33 then received a thermal cure of 30 minutes at 88° C. followed by 12 hours at 100° C. Make, mineral, and size coating weights are listed in Table 8.

After this thermal cure, the coated abrasives were single flexed (i.e., passed over a roller at an angle of 90° to allow a controlled cracking of the make and size coatings), then converted into 7.6 cm by 168 cm coated abrasive belts.

Examples 30 to 33 were compared with Comparative Example I using the ELB Particle Board Normal Force Test Procedure and the results are shown in Table 9 to 11. Particle board test conditions in Tables 9 to 11 utilize progressive sequences that evaluate the antiloading durability of the abrasive belt surface. Saw dust loading leads to both higher normal forces and, eventually, burning of both the loaded sawdust and the workpiece. Normal force ($F_n$) is the penetrating force of the abrasive article into the workpice, in this case, particle board. The lower $F_n$ is, more effectively the abrasive article penetrates the workpiece. When an abrasive article penetrates the workpiece more effectively, grinding is more efficient.

The downfeed sequences in the tables are as follows: Table 9—0.25 mm/Pass>>0.5 mm/Pass>>1.0 mm/Pass; Table 10—constant 0.45 mm/Pass; and Table 11—0.5 mm/Pass>>1.0 mm/Pass>>2.0 mm/Pass. Each downfeed condition is continued until either 12.2 cm (1.6 cm×38 cm) of particle board is removed during sanding on the narrow edge of the particle board or burning occurs. The particle board source and characteristics vary in each of Tables 9 to 11 but the same particle board was used within each test represented by Tables 9 to 11.

Examples 30 to 33 perform longer prior to loading and burning in comparison to Comparative Example I, since antiloading additives used in Examples 30–33 are believed to function to reduce the sawdust loading of the coated abrasives. Comparative Example I sands at higher normal forces than Examples 30 to 33 in Tables 9 to 11.

TABLE 7

SIZE COAT FORMULATIONS FOR EXAMPLES 30–33

| Components (weight in grams) | Ex. 30 | Ex. 31 | Ex. 32 | Ex. 33 |
|---|---|---|---|---|
| RP1 (a conventional resole phenolic resin prepared by reacting a molar excess of formaldehyde with phenol catalyzed with caustic resulting in 75% solids) | 94.4 | 100 | 100 | 96.9 |
| 3 micron calcium carbonate filler available from ECC International, Sylacauga, Alabama under the trade designation "MICROWHITE" | 20 | 20 | 20 | 20 |
| $C_{18}H_{37}NH_2$ | 5.6 | | | |
| "SR257" | | 2.5 | | |
| "FX-13" | | | 2.5 | |
| Trimethylol propane triacrylate (TMPTA) commercially available from Sartomer Co., Exton, Pennsylvania under the trade designation "SR351" | | 2.5 | 2.5 | |
| $C_{18}H_{35}NH_2$ | | | | 3.1 |
| PH1 (2,2-dimethoxy-1,2-diphenyl-1-ethanone commercially available from Ciba-Geigy, Hawthorne, New York under the trade designation "Irgacure 651") | | 1.0 | 1.0 | |
| 50/50 $H_2O$-PM - an equal parts by weight blend of water and propylene glycol monomethyl ether available from Worem Chemical Co., St. Paul, Minnesota under the trade designation "Polysolve PM" | | 16.7 | 16.7 | |
| $H_2O$ | 16.7 | | | 11.7 |

TABLE 8

COATING WEIGHTS FOR EXAMPLES 30 to 33

| Example Designation | Make Resin (g/m$^2$) | Mineral Weight (g/m$^2$) | Size Resin (g/m$^2$) |
|---|---|---|---|
| Ex. 30 | 83 | 211 | 129 |
| Ex. 31 | 83 | 211 | 129 |
| Ex. 32 | 83 | 211 | 145 |
| Ex. 33 | 88 | 186 | 132 |

TABLE 9

PARTICLE BOARD/NORMAL FORCE TEST

| Example Designation | Fn (Kg) @ 0.25 mm/pass | Fn (Kg) @ 0.50 mm/pass | Fn (Kg) @ 1.0 mm/pass | Cut (cm) |
|---|---|---|---|---|
| Comp. Ex. I | 1.86 | 4.33 | BURNING | 34 |
| Ex. 30 | 1.47 | 3.09 | 6.67 | 36.5 |
| Ex. 31 | 1.53 | 3.25 | 6.85 | 36.5 |
| Ex. 32 | 1.66 | 3.24 | 7.08 | 36.5 |

BURNING: burning of sawdust on the abrasive article and burning on the sanding path of the workpiece occurred

TABLE 10

PARTICLE BOARD/NORMAL FORCE TEST

| Example Desig-nation | Fn (Kg) @ 12 cm 0.45 mm/pass | Fn (Kg) @ 24 cm 0.45 mm/pass | Fn (Kg) @ 36 cm 0.45 mm/pass | Fn (Kg) @ 49 cm 0.45 mm/pass | Cut (cm) |
|---|---|---|---|---|---|
| Comp. | 3.76 | 4.92 | 5.12 | BURNING | 40 |

TABLE 10-continued

| PARTICLE BOARD/NORMAL FORCE TEST | | | | | |
|---|---|---|---|---|---|
| Example Designation | Fn (Kg) @ 12 cm 0.45 mm/pass | Fn (Kg) @ 24 cm 0.45 mm/pass | Fn (Kg) @ 36 cm 0.45 mm/pass | Fn (Kg) @ 49 cm 0.45 mm/pass | Cut (cm) |
| Ex. I | | | | | |
| Ex. 30 | 3.17 | 4.07 | 4.54 | BURNING | 43 |
| Ex. 31 | 3.44 | 4.09 | 4.34 | 4.86 | 49 |

BURNING: burning of sawdust on the abrasive article and burning on the sanding path of the workpiece occurred

TABLE 11

| PARTICLE BOARD/NORMAL FORCE TEST | | | | |
|---|---|---|---|---|
| Example Designation | Fn (Kg) @ 0.5 mm/pass | Fn (Kg) @ 1.0 mm/pass | Fn (Kg) @ 2.0 mm/pass | Cut (cm) |
| Comp. Ex. I | BURNING | — | — | 2.2 |
| Ex. 31 | 6.17 | 14.4 | BURNING | 27.8 |
| Ex. 33 | 3.98 | 7.64 | BURNING | 33.1 |

BURNING: burning of sawdust on the abrasive article and burning on the sanding path of the workpiece occurred
— No data could be measured because of prior burning of the belt

What is claimed is:

1. An abrasive article comprising (a) a backing having a major surface;

(b) a plurality of abrasive particles;

(c) a binder which adheres the plurality of abrasive particles to the major surface of the backing; and (d) an antiloading component of any of formulas I to V or mixtures thereof:

I

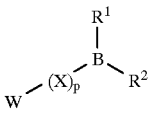

wherein $R^1$ and $R^2$ are independently OH, OR, $O^-$, $NH_2$, NHR, or $N(R)_2$, with the proviso that if either or both of $R^1$ and $R^2$ is $O^-$, then a cation is present;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

II

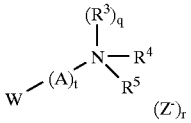

wherein $R^3$ is OH;

q is 0 or 1;

$Z^-$ is a monovalent anion;

r is 0 or 1, with the proviso that if q is 0 then r is 0, and if q is 1 then r is 1 and N carries a positive charge;

$R^4$ and $R^5$ independently are H or an alkyl group having a formula $C_nH_{2n+1}$ where n is 1 to 10;

A is C(=O), C(=O)$CH_2$, NHC(=O), OC(=O), $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

III

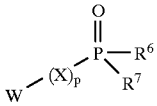

wherein $R^6$ and $R^7$ independently are $O^-$, OH, OR, $NH_2$, NHR, or $N(R)_2$, with the proviso that both $R^6$ and $R^7$ cannot be OH simultaneously or OR simultaneously, and one of $R^6$ and $R^7$ cannot be OH when the other of $R^6$ and $R^7$ is OR, and with the proviso that if only one of $R^6$ or $R^7$ is $O^-$ then a cation $M^+$ is present and with the proviso that if both $R^6$ and $R^7$ are $O^-$ then two monovalent cations $M^+$ or a divalent cation $V^{2+}$ is present; wherein $M^+$ is independently $Li^+$, $K^+$, $Na^+$, $Rb^+$, or $Cs^+$; and $V^{2+}$ is $Ca^{2+}$, $Mg^{2+}$, $Ba^{2+}$, $Zn^{2+}$, $Sr^{2+}$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$, or $Zr^{2+}$;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if either $R^6$ or $R^7$ is $O^-$ then (i) the other of $R^6$ or $R^7$ is not $O^-$ or OH; or (ii) if the other of $R^6$ or $R^7$ is $O^-$ or OH, and if X is O or p is 0, then W is not a fluorinated hydrocarbon;

IV

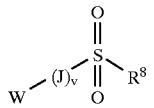

$R^8$ is OH, $O^-$, or $NH_2^-$;

wherein when $R^8$ is $O^-$, then a cation is present;

J is O, NH, $C(=O)CH_2$, $OCH_2O$, $OCH_2CH_2O$, $OCH(CH_3)CH_2O$, $OCH_2$, $OCH_2$, $CH_2$, or $OCH(CH_3)CH_2$;

v is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if v is 0 then W is not a fluorinated hydrocarbon;

$W\text{-}(A)_t\text{-}D$ V wherein D is a monovalent radical including any of: $—C(O)NR^{15}R^{16}$, $—OC(O)C(CH_2—CO_2H)_2(OH)$, $(—OOCCH_2)(HO_2C)C(OH)(CH_2CO_2H)$;

$R^{15}$ and $R^{16}$ independently are hydrogen or an alkyl group having from1 to 10 carbon atoms;

A is $C(=O)$, $C(=O)CH_2$, $NHC(=O)$, $OC(=O)$, $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if D is $—C(O)NR^{15}R^{16}$ then W is not a fluorinated hydrocarbon.

2. An abrasive article according to claim 1 wherein said antiloading component comprises formula III wherein $R^6$ and $R^7$ are $O^-$ and wherein a cation is $Na^+$ and a cation is $K^+$.

3. A method of abrading a workpiece comprising the steps of:

(a) contacting a workpiece with a peripheral portion of an abrasive article said abrasive article comprising:

(1) a backing having a major surface;

(2) a plurality of abrasive particles;

(3) a binder which adheres the plurality of abrasive particles to the major surface of the backing; and (4) an antiloading component of any of formulas I to V or mixtures thereof:

I

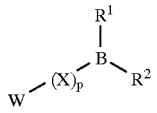

wherein $R^1$ and $R^2$ are independently OH, OR, $O^-$, $NH_2$, NHR, or $N(R)_2$, with the proviso that if either or both of $R^1$ and $R^2$ is $O^-$, then a cation is present;

R is an alkyl;

X is O, S, NH, or a divalent aliphatic (including linear, branched, and cycloaliphatic) or aromatic linking group having 20 atoms or less and containing carbon and, optionally, nitrogen, oxygen, phosphorus, or sulfur in the aliphatic or aromatic group or as a substituent to the aliphatic or aromatic group;

p is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon;

II

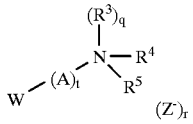

wherein $R^3$ is OH;

q is 0 or 1;

$Z^-$ is a monovalent anion;

r is 0 or 1, with the proviso that if q is 0 then r is 0, and if q is 1 then r is 1 and N carries a positive charge;

$R^4$ and $R^5$ independently are H or an alkyl group;

A is a divalent aliphatic (including linear, branched, and cycloaliphatic) or aromatic linking group having 20 atoms or less and containing carbon and, optionally, nitrogen, oxygen, phosphorus, or sulfur in the aliphatic or aromatic group or as a substituent to the aliphatic or aromatic group, with the proviso that the linking group is connected by a carbon atom to N of formula II;

t is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon;

III

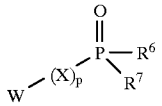

wherein $R^6$ and $R^7$ independently are $O^-$, OH, OR, $NH_2$, NHR, or $N(R)_2$, with the proviso that both $R^6$ and $R^7$ cannot be OH simultaneously or OR simultaneously, and one of $R^6$ and $R^7$ cannot be OH when the other of $R^6$ and $R^7$ is OR, and with the proviso that if only one of $R^6$ or $R^7$ is $O^-$ then a cation $M^+$ is present and with the proviso that if both $R^6$ and $R^7$ are $O^-$ then two monovalent cations $M^+$ or a divalent cation $V^{2+}$ is present; wherein $M^+$ is independently $Li^+$, $K^+$, $Na^+$, $Rb^+$, or $Cs^+$; and $V^{2+}$ is $Ca^{2+}$, $Mg^{2+}$, $Ba^{2+}$, $Zn^{2+}$, $Sr^{2+}$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$, or $Zr^{2+}$;

R is an alkyl group;

X is O, S, NH, or a divalent aliphatic (including linear, branched, and cycloaliphatic) or aromatic linking group having 20 atoms or less and containing carbon and, optionally, nitrogen, oxygen, phosphorus, or sulfur in the aliphatic or aromatic group or as a substituent to the aliphatic or aromatic group;

p is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon;

with the proviso that if either $R^6$ or $R^7$ is $O^-$ then (i) the other of $R^6$ or $R^7$ is not $O^-$ or OH, or (ii) if the other of $R^6$ or $R^7$ is $O^-$ or OH, and if X is O, X is a divalent aliphatic or aromatic linking group, or p is 0, then W is not a fluorinated hydrocarbon;

IV

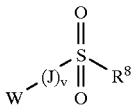

wherein $R^8$ is OH, OR, $O^-$, $NH_2$, NHR, $N(R)_2$, $N(CH_2CH_3)CH_2CH_2OC(O)CH{=}CH_2$, or

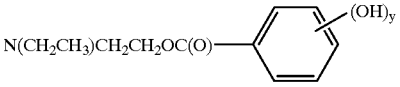

wherein when $R^8$ is $O^-$, then a cation is present;

R is an alkyl group;

J is O, NH, or a divalent aliphatic (including linear, branched, and cycloaliphatic) or aromatic linking group having 20 atoms or less and containing carbon and, optionally, nitrogen, oxygen, phosphorus, or sulfur in the aliphatic or aromatic group or as a substituent to the aliphatic or aromatic group;

v is 0 or 1;

y is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon;

with the proviso that if $R^8$ is OH, $O^-$, $NH_2$, NHR or $NR_2$ then

W is not a fluorinated hydrocarbon; or v is 1 and J is OH or NH;

$W\text{-}(A)_i\text{-}D$ V wherein D is a monovalent radical including any of:

—OH, —N=C=O, —$CO_2H$,

—$NR^{12}C(O)NR^{13}R^{14}$, —$C(O)NR^{15}R^{16}$, $OC(O)C(CH_2{-}CO_2H)_2(OH)$, $(-OOCCH_2)(HO_2C)C(OH)(CH_2CO_2H)$,

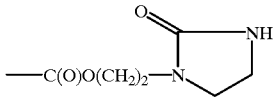

—$NR^{12}C(O)(CH_2)_2CO_2H$, —$NR^{12}C(O)(CH_2)_3OH$,

—$NHC(O)OR^{17}$, —$NR^{12}C(O)(CH_2)_2C(O)OR^{17}$,

—$NR^{12}C(O)(CH{=}CH)C(O)OR^{17}$,

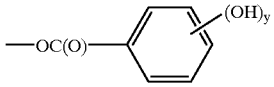

,

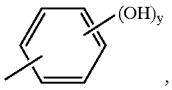

,

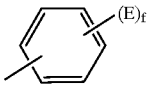

,

—$QC(O)C(R^{18}){=}CH_2$,

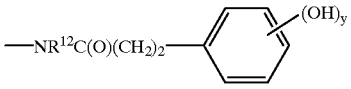

, wherein if y is 1, OH is in an ortho position,

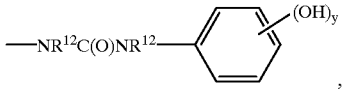

,

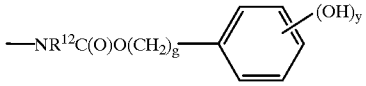

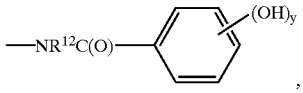

,

—$NR^{12}C(O)C(CH_3)_2NHC(O)CH{=}CH_2$,

-continued

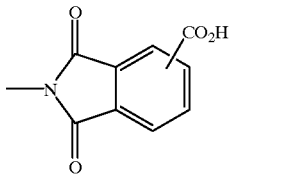

,

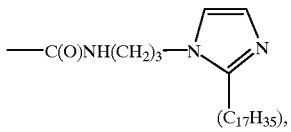

,

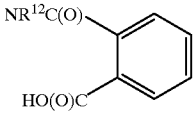

,

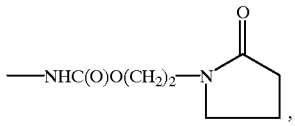

,

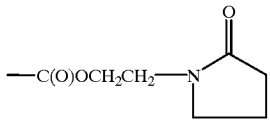

, and

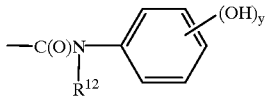

$R^{12}$ is hydrogen or an alkyl group having from one to four carbon atoms, $R^{13}$ and $R^{14}$ independently are hydrogen, an alkyl group, or an aliphatic group, which is substituted or unsubstituted, wherein the aliphatic group has 20 atoms or less and contains carbon and, optionally, nitrogen, oxygen, phosphorus, or sulfur in the aliphatic group or as a substituent to the aliphatic group;

$R^{15}$ and $R^{16}$ independently are hydrogen or an alkyl group;

$R^{17}$ is hydrogen or an alkyl group which may be saturated or unsaturated;

$R^{18}$ is hydrogen or $C_nH_{2n+1}$ where n is 1 to 8;

E is independently COOH or $COO^-$, wherein when one or two COO- groups are present, a cation is present;

Q is O or NH;

R is an alkyl group;

y is 1 to 3;

f is 1 or 2;

g is 1 to 6;

k is 0 or 1;

A is a divalent aliphatic (including linear, branched, and cycloaliphatic) or aromatic linking group having 20 atoms or less and containing carbon and, optionally, nitrogen, oxygen, phosphorus, or sulfur in the aliphatic or aromatic group or as a substituent to the aliphatic or aromatic group, with the proviso that if D is OH, N=C=O, or NHC(O)$NH_2$, then the atom of A closest to D is a carbon atom;

t is 0 or 1; and

W is an alkyl group, which may be saturated or unsaturated or W is a fluorinated hydrocarbon having a formula $C_mH_aF_{2m+1-a}$ where a is 0 to 2m and m is 4 to 50, wherein the alkyl group or the fluorinated hydrocarbon may contain oxygen atoms in a backbone of the alkyl group or the fluorinated hydrocarbon, respectively, in an amount ranging from 1 to ½ a total number of carbon atoms present in the alkyl group or the hydrocarbon;

with the proviso that if D is $—CO_2H$, $—NR^{12}C(O)NR^{13}R^{14}$, $—C(O)NR^{15}R^{16}$, or $—NHC(O)OR^{17}$ then W is not a fluorinated hydrocarbon; and (b) moving said abrasive article and the workpiece surface relative to each other.

4. A method of abrading a workpiece in accordance with claim 3 wherein the workpiece comprises wood, wood-like materials, fiberglass, varnish, polyester coatings, stained surfaces, automotive body filler, ceramics, glass, paint, primer, or metals.

5. A method of abrading a workpiece in accordance with claim 3 wherein the contacting step is performed at a force of about 0.02 kg/$cm^2$ or greater.

6. A method of abrading a workpiece in accordance with claim 3 wherein the antiloading component is any of formulas I to V or mixtures thereof:

I

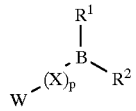

wherein $R^1$ and $R^2$ are independently OH, OR, $O^-$, $NH_2$, NHR, or $N(R)_2$, with the proviso that if either or both of $R^1$ and $R^2$ is $O^-$, then a cation is present;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

II

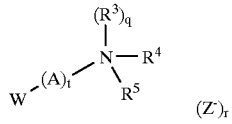

wherein $R^3$ is OH;

q is 0 or 1;

$Z^-$ is a monovalent anion;

r is 0 or 1, with the proviso that if q is 0 then r is 0, and if q is 1 then r is 1 and N carries a positive charge;

$R^4$ and $R^5$ independently are H or an alkyl group having a formula $C_nH_{2n+1}$ where n is 1 to 10;

A is C(=O), C(=O)$CH_2$, NHC(=O), OC(=O), $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

III

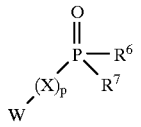

wherein $R^6$ and $R^7$ independently are $O^-$, OH, OR, $NH_2$, NHR, or $N(R)_2$, with the proviso that both $R^6$ and $R^7$ cannot be OH simultaneously or OR simultaneously, and one of $R^6$ and $R^7$ cannot be OH when the other of $R^6$ and $R^7$is OR, and with the proviso that if only one of $R^6$ or $R^7$ is $O^-$ then a cation $M^+$ is present and with the proviso that if both $R^6$ and $R^7$ are $O^-$ then two monovalent cations $M^+$ or a divalent cation $V^{2+}$ is present; wherein $M^+$ is independently $Li^+$, $K^+$, $Na^+$, $Rb^+$ or $Cs^+$; and $V^{2+}$ is $Ca^{2+}$, $Mg^{2+}$, $Ba^{2+}$, $Zn^{2+}$, $Sr^{2+}$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$, or $Zr^{2+}$;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if either $R^6$ or $R^7$ is $O^-$ then (i) the other of $R^6$ or $R^7$ is not $O^-$ or OH; or (ii) if the other of $R^6$ or $R^7$ is $O^-$ or OH, and if X is O or p is 0, then W is not a fluorinated hydrocarbon;

IV

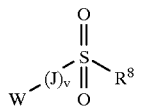

$R^8$ is OH, $O^-$, or $NH_2$;

wherein when $R^8$ is $O^-$, then a cation is present;

J is O, NH, $C(=O)CH_2$, $OCH_2O$, $OCH_2CH_2O$, $OCH(CH_3)CH_2O$, $OCH_2$, $OCH_2,CH_2$, or $OCH(CH_3)CH_2$;

v is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if v is 0 then W is not a fluorinated hydrocarbon;

$$W\text{-}(A)_t\text{-}D \qquad V$$

wherein D is a monovalent radical including any of: $—C(O)NR^{15}R^{16}$, $—OC(O)C(CH_2—CO_2H)_2(OH)$, $(—OOCCH_2)(HO_2C)C(OH)(CH_2CO_2H)$;

$R^{15}$ and $R^{16}$ independently are hydrogen or an alkyl group having from1 to 10 carbon atoms;

A is $C(=O)$, $C(=O)CH_2$, $NHC(=O)$, $OC(=O)$, $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if D is $—C(O)NR^{15}R^{16}$ then W is not a fluorinated hydrocarbon.

7. A method of abrading a workpiece in accordance with claim 3 wherein the antiloading component is selected from the group consisting of octadecyl borate, potassium octadecyl borate, octadecyldimethyl borate, docosyl borate, potassium docosyl borate, octadecyldimethylhydroxyammonium phosphate, octadecyldimethylhydroxyammonium phosphite, docosyldimethylhydroxyammonium phosphate, docosyldimethylhydroxyammonium phosphite, potassium octadecyl phosphate, potassium docosyl phosphate, sodium octadecyl phosphate, sodium docosyl phosphate, potassium hexadecyl phosphate, potassium octadecyl phosphonate, potassium tetradecyl phosphonate, sodium octadecyl sulfonate, sodium octadecyl sulfate, sodium docosyl sulfonate, sodium docosyl sulfate, octacosanoic acid, hexacosanoic acid, octadecyl urea, stearyl citrate, 2-(1-imidazolidinonyl)ethyl oleate, 2-(1-pyrrolidinonyl)ethyl oleate, 2-(1-pyrrolidinonyl)ethyl-N-stearyl carbamate, N-oleylsuccinamic acid, N-stearylsuccinamic acid, N,N'-distearyl urea, N-stearyl urea, (N(hydroxyethyl)-N-stearyl urea, N-(hydroxyethyl)-N'-stearyl urea, N,N-bis(hydroxyethyl)-N'-stearyl urea, N-(2-(hydroxyethyl)aminoethyl)-N'-stearyl urea, N-octadecyl-4-hydroxybutanamide, N-oleyl-4-hydroxybutanamide, N-(3-aminomethyl)phenylmethyl-N'-stearyl urea, oleyl N-stearyl carbamate, N-oleyl-N'-stearyl urea, N-oleylmaleamic acid, oleyl amine, N-tris(hydroxymethyl)ethyl-N'-stearyl urea, stearyl 4-hydroxybenzoate, oleyl 4-hydroxybenzoate, 3-pentadecylphenol, 3-(2-hydroxyphenyl)-N-stearylpropanamide, N-(4-hydroxyphenyl)-N'-stearyl urea, (2-hydroxyphenyl)methyl N-stearyl carbamate, stearyl acrylate, stearyl amine, ethoxylated oleic acid, N-(hydroxymethyl)octadecanamide, 2-hydroxy-N-octadecylbenzamide, N-(1'-(2'-heptadecyl)imidazoyl)propyl)octadecanamide, N-(1'-(imidazoyl)propyl)octadecanamide, N-(1'-(imidazoyl)propyl)-N'-octadecyl urea, N-(octadecyl)maleamic acid, 2-carboxy-N-(octadecyl)benzamide, 4-carboxy-N-(octadecyl)phthalimide, N-(2-(1'-pyrrolidinonyl)ethyl)-N'-octadecyl carbamate, and N-(2-(1'-morpholinoyl)ethyl)-N'-octadecyl carbamate, 2-acrylamido-2-methyl-N-(octadecyl)propanamide.

8. A method of abrading a workpiece according to claim 3 wherein the binder, the plurality of abrasive particles, and the antiloading component are present in a plurality of abrasive composites.

9. A method of abrading a workpiece according to claim 3 wherein the binder is a make coat and the abrasive article further comprises a size coat, the antiloading component being present in the size coat.

10. A method of abrading a workpiece according to claim 3 wherein the binder is a make coat and the abrasive article further comprises a size coat and a peripheral coating, the antiloading component being present in the peripheral coating.

11. A method of making an abrasive article comprising the steps of:

(a) applying a make coat binder precursor to at least one major surface of a backing;

(b) embedding a plurality of abrasive particles into the make coat binder precursor;

(c) at least partially curing or solidifying the make coat binder precursor to form a make coat;

(d) applying a size coat binder precursor composition over the make coat and the plurality of abrasive particles, said size coat binder precursor composition comprising a radiation curable size coat binder precursor, a heat curable binder precursor, and an antiloading component of any of formulas I to V or mixtures thereof:

I

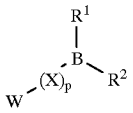

wherein $R^1$ and $R^2$ are independently OH, OR, $O^-$, $NH_2$, NHR, or $N(R)_2$, with the proviso that if either or both of $R^1$ and $R^2$ is $O^-$, then a cation is present;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

II

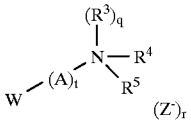

wherein $R^3$ is OH;

q is 0 or 1;

$Z^-$ is a monovalent anion;

r is 0 or 1, with the proviso that if q is 0 r is 0, and if q is 1 then r is 1 and N carries a positive charge;

$R^4$ and $R^5$ independently are H or an alkyl group having a formula $C_nH_{2n+1}$ where n is 1 to 10;

A is C(=O), C(=O)$CH_2$, NHC(=O), OC(=O), $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

III

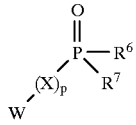

wherein $R^6$ and $R^7$ independently are $O^-$, OH, OR, $NH_2$, NHR, or $N(R)_2$, with the proviso that both $R^6$ and $R^7$ cannot be OH simultaneously or OR simultaneously, and one of $R^6$ and $R^7$ cannot be OH when the other of $R^6$ and $R^7$ is OR, and with the proviso that if only one of $R^6$ or $R^7$ is $O^-$ then a cation $M^+$ is present and with the proviso that if both $R^6$ and $R^7$ are $O^-$ then two monovalent cations $M^+$ or a divalent cation $V^{2+}$ is present; wherein $M^+$ is independently $Li^+$, $K^+$, $Na^+$, $Rb^+$, or $Cs^+$; and $V^{2+}$ is $Ca^{2+}$, $Mg^{2+}$, $Ba^{2+}$, $Zn^{2+}$, $Sr^{2+}$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$ or $Zr^{2+}$;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if either $R^6$ or $R^7$ is $O^-$ then (i) the other of $R^6$ or $R^7$ is not $O^-$ or OH; or (ii) if the other of $R^6$ or $R^7$ is $O^-$ or OH, and if X is O or p is 0, then W is not a fluorinated hydrocarbon;

IV

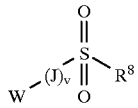

$R^8$ is OH, $O^-$, or $NH_2$;

wherein when $R^8$ is $O^-$, then a cation is present;

J is O, NH, C(50 O)$CH_2$, $OCH_2O$, $OCH_2CH_2O$, $OCH(CH_3)CH_2O$, $OCH_2$, $OCH_2$, $CH_2$, or $OCH(CH_3)CH_2$;

v is 0 or 1; and

W is an alkyl group having a formula $C_nH_{2n+1}$ where n is 12 to 30, or W is a fluorinated hydrocarbon having a formula $C_mH_aF_{2m+1}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if v is 0 then W is not a fluorinated hydrocarbon;

$$W\text{-}(A)_t\text{-}D \qquad V$$

wherein D is a monovalent radical including any of: $—C(O)NR^{15}R^{16}$, $—OC(O)C(CH_2—CO_2H)_2(OH)$, $(—OOCCH_2)(HO_2C)C(OH)(CH_2CO_2H)$;

$R^{15}$ and $R^{16}$ independently are hydrogen or an alkyl group having from1 to 10 carbon atoms;

A is C(=O), C(=O)$CH_2$, NHC(=O), OC(=O), $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if D is $—C(O)NR^{15}R^{16}$ then W is not a fluorinated hydrocarbon;

(e) at least partially curing or solidifying said size coat binder precursor composition by exposure to radiation energy; and (f) at least partially curing or solidifying said size coat binder precursor composition by exposure to heat.

12. A method of making an abrasive article in accordance with claim 11 wherein the radiation energy comprises ultraviolet light.

13. A method of making an abrasive article in accordance with claim 11 wherein the radiation curable binder precursor comprises acrylate resins, methacrylate resins, acrylated urethane resins, acrylated epoxy resins, acrylated isocyanurate resins, acrylamide resins, or mixtures thereof.

14. A method of making an abrasive article in accordance with claim 11 wherein the heat curable binder precursor comprises phenolic resins, aminoplast resins, urethane resins, epoxy resins, urea-formaldehyde resins, melamine-formaldehyde resins, bismaleimide resins, or mixtures thereof.

15. A method of making a nonwoven abrasive article comprising the steps of:

(a) coating an open, lofty, fibrous nonwoven web with a slurry comprising a binder precursor, abrasive particles, and an antiloading component of any of formulas I to V or mixtures thereof:

I

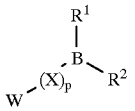

wherein $R^1$ and R2 are independently OH, OR, $O^-$, $NH_2$, NHR, or $N(R)_2$, with the proviso that if either or both of $R^1$ and $R^2$ is $O^-$, then a cation is present;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

II

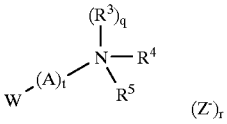

wherein $R^3$ is OH;

q is 0 or 1;

$Z^-$ is a monovalent anion;

r is 0 or 1, with the proviso that if q is 0 then r is 0, and if q is 1 then r is 1 and N carries a positive charge;

$R^4$ and $R^5$ independently are H or an alkyl group having a formula $C_nH_{2n+1}$ where n is 1 to 10;

A is C(=O), C(=O)$CH_2$, NHC(=O), OC(=O), $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

III

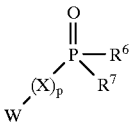

wherein $R^6$ and $R^7$ independently are $O^-$, OH, OR, $NH_2$, NHR, or $N(R)_2$, with the proviso that both $R^6$ and $R^7$ cannot be OH simultaneously or OR simultaneously, and one of $R^6$ and $R^7$ cannot be OH when the other of $R^6$ and $R^7$ is OR, and with the proviso that if only one of $R^6$ or $R^7$ is $O^-$ then a cation $M^+$ is present and with the proviso that if both $R^6$ and $R^7$ are $O^-$ then two monovalent cations $M^+$ or a divalent cation $V^{2+}$ is present; wherein $M^+$ is independently $Li^+$, $K^+$, $Na^+$, $Rb^+$, or $Cs^+$; and $V^{2+}$is $Ca^2$+, $Mg^{2+}$, $Ba^{2+}$, $Zn^{2+}$, $Sr^{2+}$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$, or $Zr^{2+}$;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if either $R^6$ or $R^7$ is $O^-$ then (i) the other of $R^6$ or $R^7$ is not $O^-$ or OH; or (ii) if the other of $R^6$ or $R^7$ is $O^-$ or OH, and if X is O or p is 0, then W is not a fluorinated hydrocarbon;

IV

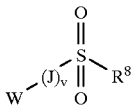

$R^8$ is OH, $O^-$, or $NH_2$;

wherein when $R^8$ is $O^-$, then a cation is present;

J is O, NH, $C(=O)CH_2$, $OCH_2O$, $OCH_2CH_2O$, $OCH(CH_3)CH_2O$, $OCH_2$, $OCH_2$, $CH_2$, or $OCH(CH_3)CH_2$;

v is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if v is 0 then W is not a fluorinated hydrocarbon;

W-(A)t-D V wherein D is a monovalent radical including any of: $—C(O)NR^{15}R^{16}$, $—OC(O)C(CH_2—CO_2H)_2(OH)$, $(—OOCCH_2)(HO_2C)C(OH)(CH_2CO_2H)$;

$R^{15}$ and $R^{16}$ independently are hydrogen or an alkyl group having from1 to 10 carbon atoms;

A is C(=O), $C(=O)CH_2$, NHC(=O), OC(=O), $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if D is $—C(O)NR^{15}R^{16}$ then W is not a fluorinated hydrocarbon; and (b) subjecting the coated backing to conditions sufficient to cure or solidify the binder precursor.

16. A method of making a bonded abrasive article comprising the steps of:

(a) molding a homogeneous mixture comprising a binder precursor, abrasive particles, and an antiloading component of any of formulas I to V or mixtures thereof:

I

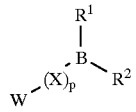

wherein $R^1$ and $R^2$ are independently OH, OR, $O^-$, $NH_2$, NHR, or $N(R)_2$, with the proviso that if either or both of $R^1$ and $R^2$ is $O^-$, then a cation is present;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

II

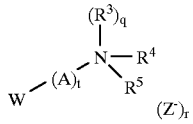

wherein $R^3$ is OH;

q is 0 or 1;

$Z^-$ is a monovalent anion;

r is 0 or 1, with the proviso that if q is 0 then r is 0, and if q is 1 then r is 1 and N carries a positive charge;

$R^4$ and $R^5$ independently are H or an alkyl group having a formula $C_nH_{2n+1}$ where n is 1 to 10;

A is C(=O), $C(=O)CH_2$, NHC(=O), OC(=O), $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

III

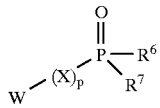

wherein $R^6$ and $R^7$ independently are $O^-$, OH, OR, $NH_2$, NHR, or $N(R)_2$, with the proviso that both $R^6$ and $R^7$ cannot be OH simultaneously or OR simultaneously, and one of $R^6$ and $R^7$ cannot be OH when the other of $R^6$ and $R^7$ is OR, and with the proviso that if only one of $R^6$ or $R^7$ is $O^-$ then a cation $M^+$ is present and with the proviso that if both $R^6$ and $R^7$ are $O^-$ then two monovalent cations $M^+$ or a divalent cation $V^{2+}$ is present, wherein $M^+$ is independently $Li^+$, $K^+$, $Na^+$, $Rb^+$, or $Cs^+$, and $V^{2+}$ is $Ca^{2+}$, $Mg^{2+}$, $Ba^{2+}$, $Zn^{2+}$, $Sr^{2+}$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$, or $Zr^{2+}$;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if either $R^6$ or $R^7$ is $O^-$ then (i) the other of $R^6$ or $R^7$ is not $O^-$ or OH; or (ii) if the other of $R^6$ or $R^7$ is $O^-$ or OH, and if X is O or p is 0, then W is not a fluorinated hydrocarbon;

IV

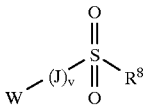

$R^8$ is OH, $O^-$, or $NH_2$;

wherein when $R^8$ is $O^-$, then a cation is present;

J is O, NH, $C(=O)CH_2$, $OCH_2O$, $OCH_2CH_2O$, $OCH(CH_3)CH_2O$, $OCH_2$, $OCH_2,CH_2$, or $OCH(CH_3)CH_2$;

v is 0 or 1; and

W is an alkyl group having a formula $C_nH_{2n+1}$ where n is 12 to 30, or W is a fluorinated hydrocarbon having a formula $C_mH_aF_{2m+1-a}$ where a is O to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to n/2 oxygen atoms for the fluorinated hydrocarbon;

with the proviso that if v is 0 then W is not a fluorinated hydrocarbon, $W\text{-}(A)_t\text{-}D$ V wherein D is a monovalent radical including any of: $—C(O)NR^{15}R^{16}$, $—OC(O)C(CH_2—CO_2H)_2(OH)$, $(—OOCCH_2)(HO_2C)C(OH)(CH_2CO_2H)$;

$R^{15}$ and $R^{16}$ independently are hydrogen or an alkyl group having from1 to 10 carbon atoms;

A is C(=O), $C(=O)CH_2$, NHC(=O), OC(=O), $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if D is $—C(O)NR^{15}R^{16}$ then W is not a fluorinated hydrocarbon;

to a desired shape; and (b) subjecting the molded mixture to conditions sufficient to cure or solidify the binder precursor.

17. A method of making a structured abrasive article comprising the steps of:

(a) providing an abrasive slurry comprising a binder precursor and an antiloading component of any of formulas I to V or mixtures thereof:

I

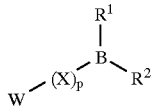

wherein $R^1$ and $R^2$ are independently OH, OR, $O^-$, $NH_2$, NHR, or $N(R)_2$, with the proviso that if either or both of $R^1$ and $R^2$ is $O^-$, then a cation is present;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

II

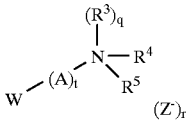

wherein $R^3$ is OH;

q is 0 or 1;

$Z^-$ is a monovalent anion;

r is 0 or 1, with the proviso that if q is 0 then r is 0, and if q is 1 then r is 1 and N carries a positive charge;

$R^4$ and $R^5$ independently are H or an alkyl group having a formula $C_nH_{2n+1}$ where n is 1 to 10;

A is C(=O), $C(=O)CH_2$, NHC(=O), OC(=O), $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

III

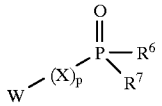

wherein $R^6$ and $R^7$ independently are $O^-$, OH, OR, $NH_2$, NHR, or $N(R)_2$, with the proviso that both $R^6$ and $R^7$ cannot be OH simultaneously or OR simultaneously, and one of $R^6$ and $R^7$ cannot be OH when the other of $R^6$ and $R^7$ is OR, and with the proviso that if only one of $R^6$ or $R^7$ is $O^-$then a cation $M^+$ is present and with the proviso that if both $R^6$ and $R^7$ are 0 then two monovalent cations $M^+$ or a divalent cation $V^{2+}$ is present; wherein $M^+$ is independently $Li^+$, $K^+$, $Na^+$, $Rb^+$, or $Cs^+$; and $V^{2+}$ is $Ca^{2+}$, $Mg^{2+}$, $Ba^{2+}$, $Zn^{2+}$, $Sr^{2+}$, $Ti^{2+}$, $Fe^{2+}$, $Co^{2+}$, $Ni^{2+}$, $Cu^{2+}$, $Ag^{2+}$, $Cd^{2+}$, $Pb^{2+}$, $Sn^{2+}$, $Pd^{2+}$, or $Zr^{2+}$;

R is an alkyl group having from1 to 10 carbon atoms;

X is O or NH;

p is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if either $R^6$ or $R^7$ is $O^-$ then (i) the other of $R^6$ or $R^7$ is not $O^-$ or OH; or (ii) if the other of $R^6$ or $R^7$ is $O^-$ or OH, and if X is O or p is 0, then W is not a fluorinated hydrocarbon;

IV

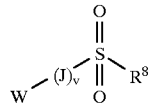

$R^8$ is OH, $O^-$, or $NH_2$;

wherein when $R^8$ is $O^-$, then a cation is present;

J is O, NH, $C(=O)CH_2$, $OCH_2O$, $OCH_2CH_2O$, $OCH(CH_3)CH_2O$, $OCH_2$, $OCH_2,CH_2$, or $OCH(CH_3)CH_2$;

v is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if v is 0 then W is not a fluorinated hydrocarbon;

$W\text{-}(A)_t\text{-}D$ V wherein D is a monovalent radical including any of: $—C(O)NR^{15}R^{16}$, $—O(O)C(CH_2—CO_2H)_2(OH)$, $(—OOCCH_2)(HO_2C)C(OH)(CH_2CO_2H)$;

$R^{15}$ and $R^{16}$ independently are hydrogen or an alkyl group having from1 to 10 carbon atoms;

A is $C(=O)$, $C(=O)CH_2$, $NHC(=O)$, $OC(=O)$, $OCH_2$, $OCH_2CH_2$, $OCH(CH_3)CH_2$;

t is 0 or 1; and

W is an alkyl group having a formula $C_nH_{2n+1}$ where n is 12 to 30, or W is a fluorinated hydrocarbon having a formula $C_mH_aF_{2m+1-a}$ where a is 0 to 2m, and m is 6 to 30, and wherein the alkyl group or the fluorinated hydrocarbon may contain oxygen atoms in a backbone of the alkyl group or the fluorinated hydrocarbon, respectively, in an amount ranging from 1 to n/2 oxygen atoms for the alkyl group or 1 to m/2 oxygen atoms for the fluorinated hydrocarbon;

with the proviso that if D is $—C(O)NR^{15}R^{16}$ then W is not a fluorinated hydrocarbon;

(b) introducing the abrasive slurry onto an outer surface of a production tool wherein the production tool has a specified pattern;

(c) introducing a backing to the outer surface of the production tool such that the slurry wets one major surface of the backing to form an intermediate article;

(d) at least partially curing the binder precursor before the intermediate article departs from the outer surface of the production tool to form a structured abrasive article; and (e) removing the structured abrasive article from the production tool.

18. A method of making a structured abrasive article according to claim 17 wherein said binder precursor is curable by radiation energy.

19. A method of making a structured abrasive article according to claim 17 wherein said binder precursor comprises aminoplast resins, urethane resins, epoxy resins, acrylate resins, acrylated urethane resins, acrylated epoxy resins, acrylated isocyanurate resins, acrylamide resins, or mixtures thereof.

* * * * *

UNITED STATES PATENT AND TRADEMARK OFFICE

CERTIFICATE OF CORRECTION

PATENT NO. : 5,954,844
DATED : September 21, 1999
INVENTOR(S) : Kam W. Law, Walter L. Harmer, Alan R. Kirk, and Ernest L. Thurber It is certified that error appears in the above-identified patent and that said Letters Patent is hereby corrected as shown below:

Column 54, claim 7,
Lines 46-47, "(N(hydroxyethyl)-N-stearyl" should read -- N (hydroxyethyl -$N^1$-stearyl -- .

Column 55, claim 11,
Line 62, "q is 0 " should read -- q is o then r O -- .

Column 56, claim 11,
Line 60, "C (50 0)$CH_2$" should read -- C(C=O)$CH_2$ -- .

Column 58, claim 15,
Line 59, "$Ca^2$+" should read -- $Ca^{2+}$ --.

Column 63, claim 17,
Line 15, "$R^7$ are o" should read -- $R^7$ are $O^-$ -- .

Signed and Sealed this

Eleventh Day of September, 2001

*Attest:*

Nicholas P. Godici

NICHOLAS P. GODICI
*Acting Director of the United States Patent and Trademark Office*

*Attesting Officer*